US009996049B2

(12) United States Patent
Maeshima et al.

(10) Patent No.: US 9,996,049 B2
(45) Date of Patent: Jun. 12, 2018

(54) PROCESS CARTRIDGE INCLUDING A COUPLING MEMBER AND A SHEET THAT CONTACTS THE COUPLING MEMBER

(71) Applicant: CANON KABUSHIKI KAISHA, Tokyo (JP)

(72) Inventors: Hideki Maeshima, Mishima (JP); Masato Tanabe, Susono (JP); Keisuke Nomura, Okazaki (JP); Hiroki Shimizu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/369,979

(22) Filed: Dec. 6, 2016

(65) Prior Publication Data

US 2017/0082971 A1 Mar. 23, 2017

Related U.S. Application Data

(63) Continuation-in-part of application No. 14/736,723, filed on Jun. 11, 2015, which is a continuation of (Continued)

(30) Foreign Application Priority Data

Dec. 14, 2012 (JP) ..... 2012-273205

(51) Int. Cl.
*G03G 15/00* (2006.01)
*G03G 21/16* (2006.01)
*G03G 21/18* (2006.01)

(52) U.S. Cl.
CPC ..... *G03G 21/1803* (2013.01); *G03G 21/186* (2013.01); *G03G 21/1825* (2013.01); (Continued)

(58) Field of Classification Search
CPC ..... G03G 15/757; G03G 21/1671; G03G 21/1676; G03G 21/18; G03G 21/1803; (Continued)

(56) References Cited

U.S. PATENT DOCUMENTS 4,989,037 A * 1/1991 Nagatsuna ..... G03G 15/08 100/172
6,947,686 B2 9/2005 Kawai et al.
(Continued)

FOREIGN PATENT DOCUMENTS

JP H02-21049 A 1/1990
JP H09-114160 A 5/1997
(Continued)

OTHER PUBLICATIONS

Decision on Grant in Russian Patent Application No. 2015128302, dated Dec. 16, 2016 (with English translation).
(Continued)

*Primary Examiner* — Joseph S Wong
(74) *Attorney, Agent, or Firm* — Fitzpatrick, Cella, Harper & Scinto

(57) ABSTRACT

A process cartridge including a photosensitive drum; a developing roller; a rotatable roller having a rotation shaft in a position deviated from an axis of the developing roller; an Oldham coupling member at an end portion of the shaft of the rotatable roller; an urging member for urging the drive receiving portion; a supporting portion supporting the drive receiving portion; an abutting portion receiving the supporting portion urged by the urging member, an elastic sheet positioned to contact at least part of the Oldham coupling member, wherein the abutting portion is positioned outside an outer periphery of the drum on a plane perpendicular to the shaft of the rotatable roller.

2 Claims, 24 Drawing Sheets

Related U.S. Application Data application No. PCT/JP2013/084171, filed on Dec. 13, 2013.

(52) U.S. Cl.
CPC ..... *G03G 21/1842* (2013.01); *G03G 21/1864* (2013.01); *G03G 15/757* (2013.01); *G03G 21/1671* (2013.01); *G03G 21/1676* (2013.01); *G03G 21/18* (2013.01); *G03G 21/1821* (2013.01); *G03G 21/1857* (2013.01); *G03G 2215/0132* (2013.01)

(58) Field of Classification Search
CPC ..... G03G 21/1821; G03G 21/1825; G03G 21/1842; G03G 21/1857; G03G 21/186; G03G 21/1864
See application file for complete search history.

(56) References Cited

U.S. PATENT DOCUMENTS

| | | | |
|---|---|---|---|
| 6,968,142 | B2 | 11/2005 | Arimitsu et al. |
| 6,980,758 | B2 | 12/2005 | Murayama et al. |
| 7,046,942 | B2 | 5/2006 | Arimitsu et al. |
| 7,072,594 | B2 | 7/2006 | Hoshi et al. |
| 7,072,603 | B2 | 7/2006 | Tsuzuki et al. |
| 7,088,939 | B2 | 8/2006 | Maeshima et al. |
| 7,127,194 | B2 | 10/2006 | Hoshi et al. |
| 7,158,735 | B2 | 1/2007 | Murayama et al. |
| 7,162,181 | B2 | 1/2007 | Maeshima et al. |
| 7,318,989 | B2 | 1/2008 | Kotsugai et al. |
| 7,340,197 | B2 | 3/2008 | Murayama et al. |
| 7,349,649 | B2 | 3/2008 | Hoshi et al. |
| 7,715,746 | B2 | 5/2010 | Tanabe et al. |
| 7,813,671 | B2 | 10/2010 | Nittani et al. |
| 7,894,733 | B2 | 2/2011 | Tanabe et al. |
| 7,953,340 | B2 | 5/2011 | Tanabe et al. |
| 8,213,828 | B2 | 7/2012 | Murayama et al. |
| 8,301,054 | B2 | 10/2012 | Tanabe et al. |
| 8,369,743 | B2 | 2/2013 | Maeshima et al. |
| 8,565,639 | B2 | 10/2013 | Nittani et al. |
| 8,583,006 | B2 | 11/2013 | Murayama et al. |
| 8,688,003 | B2 | 4/2014 | Maeshima et al. |
| 9,063,501 | B2 | 6/2015 | Hirukawa et al. |
| 2004/0131381 | A1 | 7/2004 | Kawasumi et al. |
| 2006/0034637 | A1 | 2/2006 | Kim et al. |
| 2008/0095549 | A1 | 4/2008 | Yoshizawa |
| 2008/0138114 | A1 | 6/2008 | Chadani et al. |
| 2008/0138115 | A1 | 6/2008 | Chadani et al. |
| 2009/0297211 | A1 | 12/2009 | Kanno et al. |
| 2009/0317134 | A1* | 12/2009 | Miyabe ..... G03G 21/186 399/119 |
| 2010/0080621 | A1 | 4/2010 | Itabshi |
| 2011/0150526 | A1* | 6/2011 | Sasaki ..... G03G 21/1821 399/111 |
| 2011/0200358 | A1 | 8/2011 | Murakawa |
| 2011/0268473 | A1 | 11/2011 | Hashimoto |
| 2013/0223853 | A1 | 8/2013 | Chadani et al. |
| 2013/0272753 | A1 | 10/2013 | Fukasawa et al. |
| 2013/0308978 | A1 | 11/2013 | Nittani et al. |
| 2014/0169829 | A1 | 6/2014 | Maeshima et al. |
| 2014/0178097 | A1 | 6/2014 | Maeshima et al. |
| 2015/0277367 | A1 | 10/2015 | Maeshima et al. |
| 2016/0018784 | A1 | 1/2016 | Maeshima et al. |
| 2016/0041521 | A1 | 2/2016 | Maeshima et al. |

FOREIGN PATENT DOCUMENTS

| | | | |
|---|---|---|---|
| JP | 2002-189401 | A | 7/2002 |
| JP | 2003-295596 | A | 10/2003 |
| JP | 20090297211 | A1 | 12/2009 |
| JP | 4464435 | B2 | 5/2010 |
| JP | 2011-048399 | A | 3/2011 |
| JP | 4780163 | B2 | 9/2011 |
| JP | 20110268473 | A1 | 11/2011 |
| RU | 2367016 | C2 | 10/2007 |

OTHER PUBLICATIONS

Official Communication in European Patent Application No. 13862816.9, dated Jul. 8, 2016.
International Search Report for International Patent Application No. PCT/JP2013/084171.
Examination Report in Indian Patent Application No. 3912/CHENP/2015, dated Feb. 16, 2018.
Decision on Grant in Russian Patent Application No. 2017113777, dated Mar. 26, 2018 (with English translation).

* cited by examiner

PROCESS CARTRIDGE INCLUDING A COUPLING MEMBER AND A SHEET THAT CONTACTS THE COUPLING MEMBER

TECHNICAL FIELD

The present invention relates to a process cartridge detachably mountable to an image forming apparatus and an image forming apparatus including the process cartridge. The image forming apparatus forms an image on a recording material using an image forming process. Examples of the image forming apparatus include a printer, a copying machine, a facsimile machine, or word processor and a multi-function machine of these machines.

BACKGROUND ART

Conventionally, in an image forming apparatus using an electrophotographic image forming process, a photosensitive drum and process parts actable on the photosensitive drum are unfixed into a cartridge. Further, a process cartridge type in which this cartridge is detachably mountable to an apparatus main assembly of the image forming apparatus is employed.

According to this process cartridge type, maintenance of the image forming apparatus can be performed by a user himself (herself). As a result, an operationality can be improved remarkably and the process cartridge type is widely used in image forming apparatuses.

Japanese Patent No. 4464435 discloses a color electrophotographic image forming apparatus in which a plurality of process cartridges are arranged in a line. Here, in the process cartridge, a drum unit including the photosensitive drum and a developing unit including a developing roller are connected rotatably by a swing center. Further, the photosensitive drum is provided with a drum coupling in one end side with respect to an axial direction of the photosensitive drum. Further, when the process cartridge is mounted in the apparatus main assembly, the drum coupling engages with a main assembly(-side) coupling provided in the apparatus main assembly, so that a first difference is transmitted.

Further, the developing roller is provided with an Oldham coupling which is a shaft coupling member in one end side with respect to an axial direction of the developing roller. The contact engages with a main assembly(-side) drive transmitting member, and is constituted by a driving-side engaging portion provided movably in a direction crossing an axis of the developing roller, a follower-side engaging portion fixed to the developing roller, and an intermediary engaging portion provided between the follower-side engaging portion and the follower-side engaging portion. Further, when the process cartridge is mounted in the apparatus main assembly, the driving-side engaging portion engages with a main assembly(-side) developing (means) coupling provided in the apparatus main assembly, so that a second difference is transmitted. That is, drive transmission from the apparatus main assembly to the process cartridge is performed at independent two positions.

In the process cartridge as described above, independent drive transmission is performed on an axis of the photosensitive drum and an axis of the developing roller. In this way, in the case where the cartridge of the photosensitive drum and the coupling of the developing roller are in a relationship in which these couplings are adjacent to each other, an interval between the drive transmitting member for the photosensitive drum and the drive transmitting member for the developing roller narrows. As a result, a degree of flexibility in constitution of the apparatus main assembly or the process cartridge narrows.

SUMMARY OF THE INVENTION

Accordingly, it is an object of the present invention is to provide a process cartridge and an image forming apparatus which are capable of broadening an interval between drive input to a photosensitive drum and drive input to a developing roller.

According to the present invention, there is provided a process cartridge comprising: a photosensitive drum; a rotatable developing roller for developing an electrostatic latent image formed on the photosensitive drum; a rotatable roller having a rotation shaft in a position deviated from an axis of the developing roller, for transmitting a driving force to the developing roller; a coupling member disposed at an end portion of the shaft of the rotatable roller; a driving force receiving portion, provided on the coupling member and movable in a direction crossing the shaft of the rotatable roller, for receiving a driving force to be transmitted to the developing roller; an urging member for urging the drive receiving portion in the direction crossing the shaft of the rotatable roller; a supporting portion for rotatably supporting the drive receiving portion so as to be movable together with the drive receiving portion toward the rotatable roller in the direction crossing the shaft of the rotatable roller; and an abutting portion for receiving the supporting portion urged by the urging member, wherein the abutting portion is positioned outside an outer periphery of the photosensitive drum on a plane perpendicular to the shaft of the rotatable roller.

Further, according to the present invention, there is provided a process cartridge comprising: a photosensitive drum; a rotatable developing roller for developing an electrostatic latent image formed on the photosensitive drum; a rotatable roller having a rotation shaft in a position deviated from an axis of the developing roller, for transmitting a driving force to the developing roller; a coupling member disposed at an end portion of the shaft of the rotatable roller; a driving force receiving portion, provided on the coupling member and movable in a direction crossing the shaft of the rotatable roller, for receiving a driving force to be transmitted to the developing roller; an urging member for urging the drive receiving portion in the direction crossing the shaft of the rotatable roller; a supporting portion for rotatably supporting the drive receiving portion so as to be movable together with the drive receiving portion toward the rotatable roller in the direction crossing the shaft of the rotatable roller; and an abutting portion for receiving the supporting portion urged by the urging member, wherein the abutting portion is provided so that a point of contact between the abutting portion and the supporting portion is positioned outside an outer peripheral surface of the photosensitive drum on a plane perpendicular to the shaft of the rotatable roller.

Further, according to the present invention, there is provided an image forming apparatus comprising: an image forming apparatus main assembly including a driving member for providing a difference; and a process cartridge detachably mountable to the image forming apparatus main assembly, wherein the process cartridge includes: a photosensitive drum; a rotatable developing roller for developing an electrostatic latent image formed on the photosensitive drum; a rotatable roller having a rotation shaft in a position deviated from an axis of the developing roller, for transmitting a driving force to the developing roller; a coupling member disposed at an end portion of the shaft of the rotatable roller; a driving force receiving portion, provided on the coupling member and movable in a direction crossing the shaft of the rotatable roller, for receiving a driving force to be transmitted to the developing roller; an urging member for urging the drive receiving portion in the direction crossing the shaft of the rotatable roller; a supporting portion for rotatably supporting the drive receiving portion so as to be movable together with the drive receiving portion toward the rotatable roller in the direction crossing the shaft of the rotatable roller; and an abutting portion for receiving the supporting portion urged by the urging member, wherein the abutting portion is positioned outside an outer periphery of the photosensitive drum on a plane perpendicular to the shaft of the rotatable roller.

Further, according to the present invention, there is provided an image forming apparatus comprising: an image forming apparatus main assembly including a driving member for providing a difference; and a process cartridge detachably mountable to the image forming apparatus main assembly, wherein the process cartridge includes: a photosensitive drum; a rotatable developing roller for developing an electrostatic latent image formed on the photosensitive drum; a rotatable roller having a rotation shaft in a position deviated from an axis of the developing roller, for transmitting a driving force to the developing roller; a coupling member disposed at an end portion of the shaft of the rotatable roller; a driving force receiving portion, provided on the coupling and movable in a direction crossing the shaft of the rotatable roller, for receiving the driving force to be transmitted to the developing roller; an urging member for urging the driving force receiving portion in the direction crossing the shaft of the rotatable roller; a supporting portion for rotatably supporting the driving force receiving portion so as to be movable together with the driving force receiving portion toward the rotatable roller in the direction crossing the shaft of the rotatable roller; and an abutting portion for receiving the supporting portion urged by the urging member, wherein the abutting portion is provided so that a point of contact between the abutting portion and the supporting portion is positioned outside an outer peripheral surface of the photosensitive drum on a plane perpendicular to the shaft of the rotatable roller.

EMBODIMENTS FOR CARRYING OUT THE PRESENT INVENTION

First Embodiment

In the following, an electrophotographic image forming apparatus according to First Embodiment of the present invention and a process cartridge used therein will be described in accordance with the drawings.

(General Structure of Image Forming Apparatus)

Figure 2:
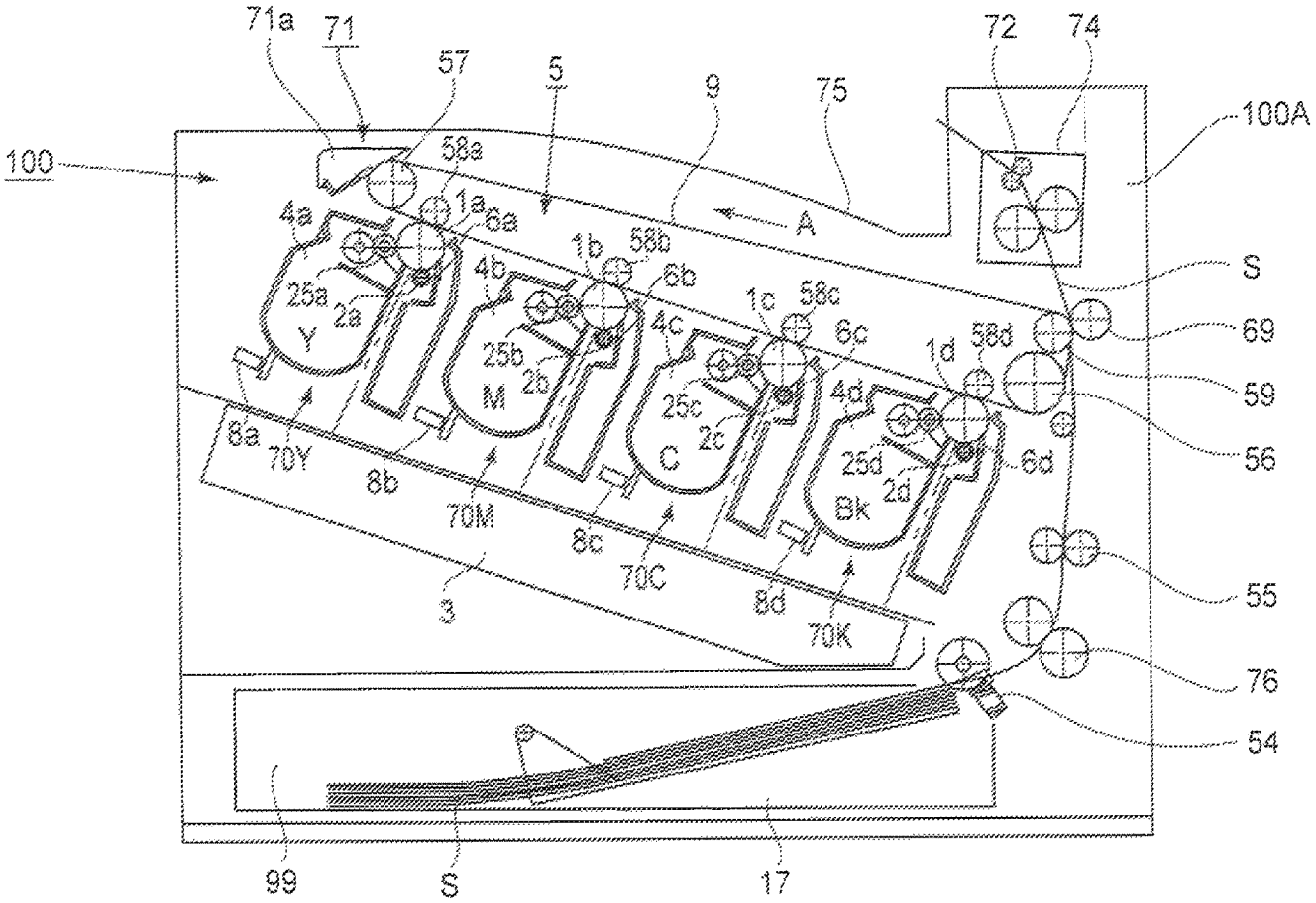
FIG. 2 is a principal sectional view of an image forming apparatus in the embodiment of the present invention.

First, a general structure of an electrophotographic image forming apparatus (hereinafter referred to as an "image forming apparatus") 100 will be described using FIG. 2. As shown in FIG. 2, detachably mountable four process cartridges 70 (70Y, 70M, 70C, 70K) are mounted. Further, in this embodiment, an upstream-side side of the process cartridge 70 with respect to a mounting direction to the image forming apparatus 100 is defined as a front (surface) side, and a downstream-side side of the process cartridge 70 with respect to the mounting direction is defined as a rear (surface) side. In FIG. 2, the respective process cartridges 70 are inclined and juxtaposed in an apparatus main assembly 100A with respect to a horizontal direction ht.

The process cartridge 70 includes electrophotographic photosensitive drums (hereinafter referred to as "photosensitive drums") 1 (1*a*, 1*b*, 1*c*, 1*d*), and at a periphery of the photosensitive drums 1, process means such as charging rollers 2 (2*a*, 2*b*, 2*c*, 2*d*), developing rollers 25 (25*a*, 25*b*, 25*c*, 25*d*), and cleaning members 6 (6*a*, 6*b*, 6*c*, 6*d*) are integrally provided.

The charging roller 2 electrically charges the surface of the photosensitive drum 1 uniformly, and the developing roller 25 develops a latent image, formed on the photosensitive drum 1, with a toner to visualize the latent image. The cleaning member 6 removes the toner remaining on the photosensitive drum 1 after a toner image formed on the photosensitive drum 1 is transferred onto a recording material.

Further, below the process cartridges 70, a scanner unit 3 for forming the latent image on the photosensitive drums 1 by subjecting the photosensitive drums 1 to selective exposure to light on the basis of image information is provided.

At a lower portion of the apparatus main assembly 100A, a cassette 99 in which sheets of the recording material S are accommodated is mounted. Further, a recording material feeding portion is provided so that the recording material S can be fed to an upper portion of the apparatus main assembly 100A by being passed through a secondary transfer roller 69 and a fixing portion 74. That is, a feeding roller 54 for separating and feeding the sheets of the recording material S in the cassette 99 in a one-by-one manner, a feeding roller pair 76 for feeding the fed recording material S, and a registration roller pair 55 for synchronizing the latent image formed on the photosensitive drum 1 with the recording material S are provided.

Further, above the process cartridges 70 (70Y, 70M, 70C, 70K), an intermediary transfer unit 5 as an intermediary transfer means onto which the toner image formed on each of the photosensitive drums 1 (1*a*, 1*b*, 1*c*, 1*d*) is to be transferred is provided. The intermediary transfer unit 5 includes a driving roller 56, a follower roller 57, primary transfer rollers 58 (58*a*, 58*b*, 58*c*, 58*d*) at positions opposing the photosensitive drums 1 for the respective colors, and an opposite roller 59 at a position opposing the secondary transfer roller 69 are provided. Around these rollers, a transfer belt 9 is extended and stretched.

Further, the transfer belt 9 is circulated and moved so as to oppose and be contacted to all of the photosensitive drums 1. Then, the toner images are primary-transferred from the photosensitive drums 1 onto the transfer belt 9 by applying a voltage to the primary transfer rollers 58 (58*a*, 58*b*, 58*c*, 58*d*). Then, by voltage application to the secondary transfer roller 69 and the opposite roller 59 disposed inside the transfer belt 9, the toner images are transferred from the transfer belt 9 onto the recording material S.

During image formation, while rotating each of the photosensitive drums 1, the photosensitive drum 1 uniformly charged by the charging roller 2 is subjected to selective exposure to light emitted from the scanner unit 3. By this, an electrostatic latent image is formed on the photosensitive drum 1. The latent image is developed by the developing roller 25. By this, the toner images of the respective colors are formed on the photosensitive drums 1, respectively. In synchronism with this image formation, the registration roller pair 55 feeds the recording material S to a secondary transfer position where the secondary transfer roller 69 opposing the opposite roller 59 is contacted to the transfer belt 9.

Then, by applying a transfer bias voltage to the secondary transfer roller 69, the respective color toner images are secondary-transferred from the transfer belt 9 onto the recording material S. By this, a color image is formed on the recording material S. The recording material S on which the color image is formed is heated and pressed by the fixing portion 74, so that the toner images are fixed on the recording material S. Thereafter, the recording material S is discharged onto a discharge portion 75 by a (sheet-)discharging roller pair 72. The fixing portion 75 is disposed at an upper portion of the apparatus main assembly 100A.

(Process Cartridge)

Figure 3:
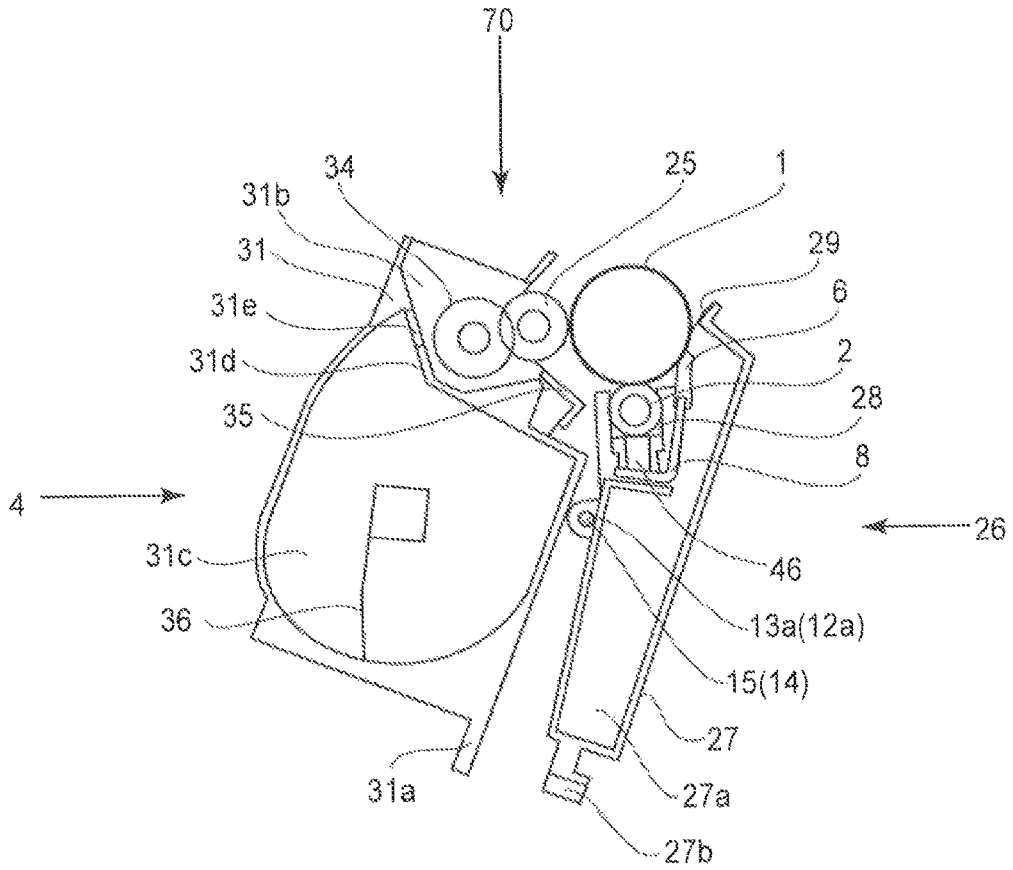
FIG. 3 is a principal sectional view of a process cartridge in the embodiment of the present invention.

Next, the process cartridge 70 in this embodiment will be described with reference to FIGS. 3 to 5. FIG. 3 is a principal sectional view of the process cartridge 70 in which the toner is accommodated. Incidentally, the process cartridge 7Y accommodating the toner of yellow, the process cartridge 7M accommodating the toner of magenta, the process cartridge 7C accommodating the toner of cyan, and the process cartridge 7K accommodating the toner of black have the same cartridge constitution.

The respective process cartridges 70 include drum units 26 (26*a*, 26*b*, 26*c*, 26*d*) as a first unit and developing units 4 (4*a*, 4*b*, 4*c*, 4*d*) as a second unit. The drum unit 26 includes at least the photosensitive drum 1. In this embodiment, the drum unit 26 includes the photosensitive drum 1, the charging roller 2 and the cleaning member 6. Further, the developing unit 4 includes the developing roller 25 and a rotatable member, described later, for transmitting the difference to the developing roller 25.

To a frame 27 of the drum unit 26, the photosensitive drum 1 is rotatably mounted via a front drum bearing 10 and a rear drum bearing 11. The photosensitive drum 1 is provided with a drum coupling 16 and a flange 19 as a first drum coupling member in one end side with respect to an axial direction thereof.

At a periphery of the photosensitive drum 1, as described above, the charging roller 2 and the cleaning member 6 are disposed. The cleaning member 6 is constituted by an elastic member formed with a rubber blade and a cleaning supporting member 8. A free end portion of the rubber blade disposed in contact with the photosensitive drum 1 counter directionally to a rotational direction of the photosensitive drum 1. Further, a residual toner removed from the surface of the photosensitive drum 1 by the cleaning member 6 falls into a removed toner chamber 27*a*.

By transmitting a driving force of a main assembly driving motor (not shown) as a driving source to the photosensitive drum 1, so that the photosensitive drum 1 is rotationally driven depending on an image forming operation. The charging roller 2 is rotatably mounted to the drum unit 26 via a charging roller bearing 28. Further, the charging roller 2 is urged against the photosensitive drum 1 by a charging roller urging member 46, thus being rotated by the rotation of the photosensitive drum 1.

The developing unit 4 has a constitution including the developing roller 26, rotating in contact with the photosensitive drum 1 in an arrow B direction, and a developing device frame 31 for supporting the developing roller 25. Further, the developing unit 4 is constituted by a developing chamber 31*b* in which the developing roller 25 is disposed and by a toner accommodating chamber 31*c*, disposed below the developing chamber 31*b*, for accommodating container for accommodating the toner. These chambers are partitioned by a partition wall 31*d*. Further, the partition wall 31*d* is provided with an opening 31*e* through which the toner passes when the toner is fed from the toner accommodating chamber 31*c* to the developing chamber 31*b*. The developing roller 25 is rotatably supported by the developing (device) frame 31 via a front developing (means) bearing 12 and a rear developing (means) bearing 13 provided in both sides of the developing device frame 31, respectively.

Further, at a periphery of the developing roller 25, a developer supplying roller 34 as a rotatable member rotatable in contact with the developing roller 25, and a developing blade 35 for regulating a toner layer on the developing roller 25 are provided. Further, in the toner accommodating chamber 31*c* in the developing frame 31, a toner feeding member 36 for feeding the toner into the developing chamber 31*b* through the opening 31*e* while stirring the toner accommodated in the toner accommodating chamber 31*c* is provided.

Figure 4:
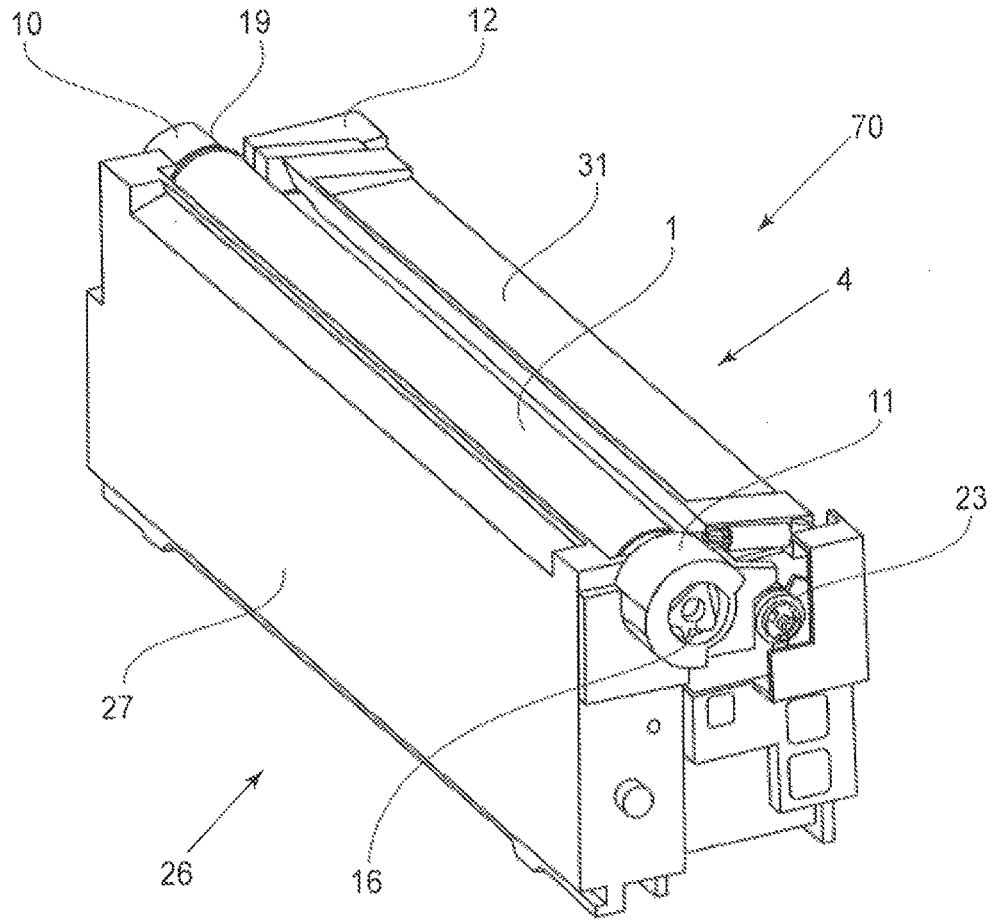
FIG. 4 is a general perspective view of the process cartridge in the embodiment of the present invention.
Figure 5:
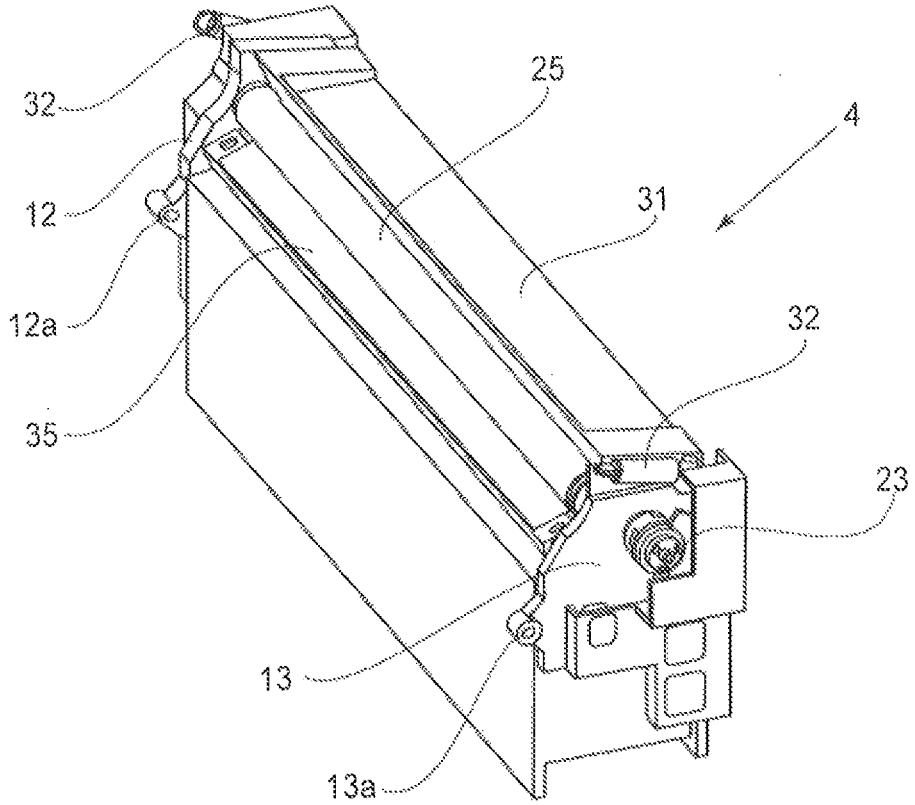
FIG. 5 is a general perspective view of the developing unit in the embodiment of the present invention.

FIG. 4 is a general perspective view of the process cartridge 70. FIG. 5 is a general perspective view of the developing unit 4. To the drum unit 26, the developing unit 4 is rotatably mounted. A front supporting pin 14 and a rear supporting pin 15 which are press-fitted in the drum unit frame 27 are engaged with hang holes 12*a* and 13*a*, respectively, of the rear developing bearing 13. As a result, the developing unit 4 is rotatably supported by the frame 27 with the supporting pins 14 and 15 as rotation shafts.

Further, the frame 27 is provided with a front drum bearing 10 and a rear drum bearing 11 which rotatably support the photosensitive drum 1. The rear drum bearing 11 supports a drum coupling 16 coupled to the photosensitive drum 1. Further, the front drum bearing 10 supports the flange. Here, the drum coupling 16 is a drum coupling member for transmitting a rotational driving force from the apparatus main assembly 100A to the photosensitive drum 1.

The developing frame 31 is provided with the front and rear developing bearings 12 and 13 for rotatably supporting the developing roller 25. Further, the developing unit 4 is constituted so as to be urged against the drum unit 26, during image formation of the process cartridge 70, by an urging spring 32 provided at each of ends of the developing frame 31. By these urging spring 32, an urging force for bringing the developing roller 25 into contact with the photosensitive drum 1 with, as rotation centers, the hang holes 12*a* and 13*a* of the front and rear developing bearings 12 and 13 is generated.

(Insertion and Mounting Constitution of Process Cartridge into Image Forming Apparatus Main Assembly)

Figure 6:
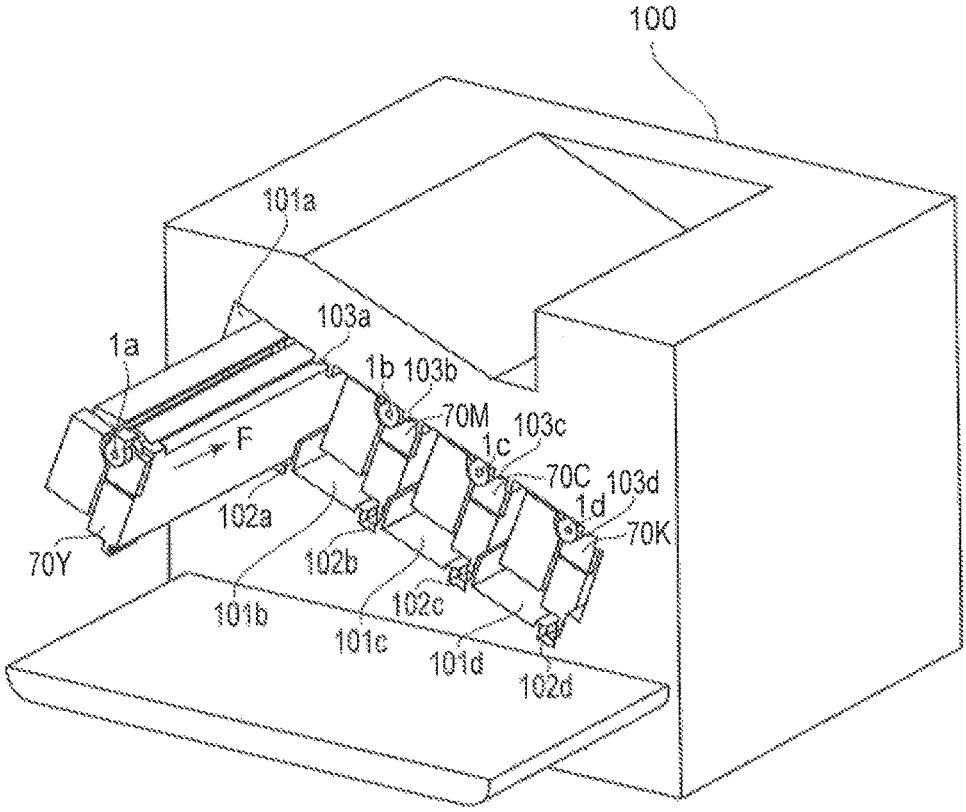
FIG. 6 is a schematic view of mounting of a process cartridge in the image forming apparatus in the embodiment of the present invention.

In FIG. 6, a constitution in which the process cartridge 70 is inserted into the image forming apparatus 100 will be described. In this embodiment, a constitution in which the process cartridges 70 are inserted through openings 101 (101*a*, 101*b*, 101*c*, 101*d*) of the image forming apparatus 100 is a constitution in which the process cartridges 70 are inserted from the front side to the rear side in a direction (arrow F direction in the figure) parallel to an axial direction of the photosensitive drums 1.

In the image forming apparatus 100, main assembly upper mounting guide portions 103 (103*a*, 103*b*, 103*c*, 103*d*) (FIG. 6) which are first main assembly guide portions are provided in an upper side with respect to a vertical direction. Further, in the image forming apparatus 100, main assembly lower mounting guide portions 102 (102*a*, 102*b*, 102*c*, 102*d*) (FIG. 6) which are second main assembly mounting guide portions are provided in a lower side with respect to the vertical direction. Each of the main assembly upper guide portions 103 and the main assembly lower guide portions 102 has a guide shape extending along an insertion direction F of each of the process cartridge 70.

The process cartridge 70 is placed in a front side of the main assembly lower mounting guide portion 102 with respect to a mounting direction and then is moved in the insertion direction F along the main assembly upper and lower mounting guide portions 102 and 103, thus being inserted into the image forming apparatus 100.

Figure 7:
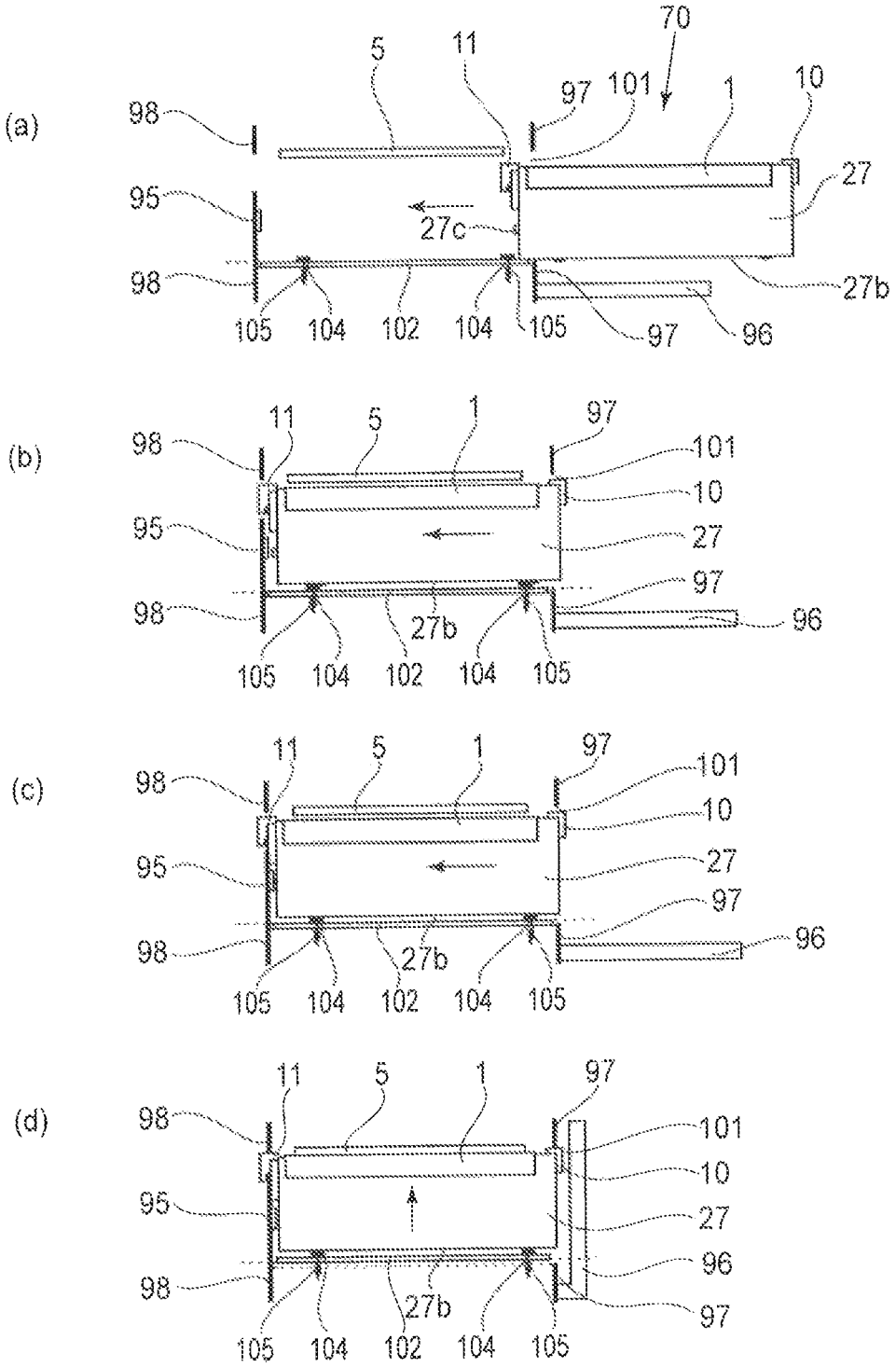
FIG. 7 includes are schematic views for illustrating an operation of mounting the process cartridge in an image forming apparatus main assembly in the embodiment of the present invention.

An operation of mounting the process cartridge 70 into the apparatus main assembly 100A will be described. FIG. 7(*a*) is a schematic view for illustrating a state before mounting of the process cartridge 70 into the apparatus main assembly 100A.

FIG. 7(*b*) is a schematic view for illustrating a state during the mounting of the process cartridge 70 into the apparatus main assembly 100A. The main assembly lower mounting guide portion 102 provided in the apparatus main assembly 100A is provided with a main assembly(-side) pressing member 104 and a main assembly(-side) pressing spring 105 which press and position the process cartridge 70 against the apparatus main assembly. When the process cartridge 70 is mounted in the apparatus main assembly 100A, a guide portion 27*b* of the frame 27 runs on the main assembly pressing portion 104, so that the process cartridge 70 moves upward with respect to the vertical direction of the image forming apparatus 100. Then, the guide portion 27*b* of the frame 27 is in a state in which the guide portion 27*b* is spaced from a guide surface of the main assembly lower mounting guide portion 102.

FIG. 7(*c*) is a schematic view for illustrating a state in which the process cartridge 70 is mounted into the apparatus main assembly 100A until the process cartridge 70 abuts against a rear(-side) plate 98. In the state in which the guide portion 27*b* of the frame 27 runs on the main assembly pressing member 104, when the mounting of the process cartridge 7 is further continued, an abutting portion provided on the drum unit 26 contacts the rear plate 98 of the apparatus main assembly 100A.

Figure 8:
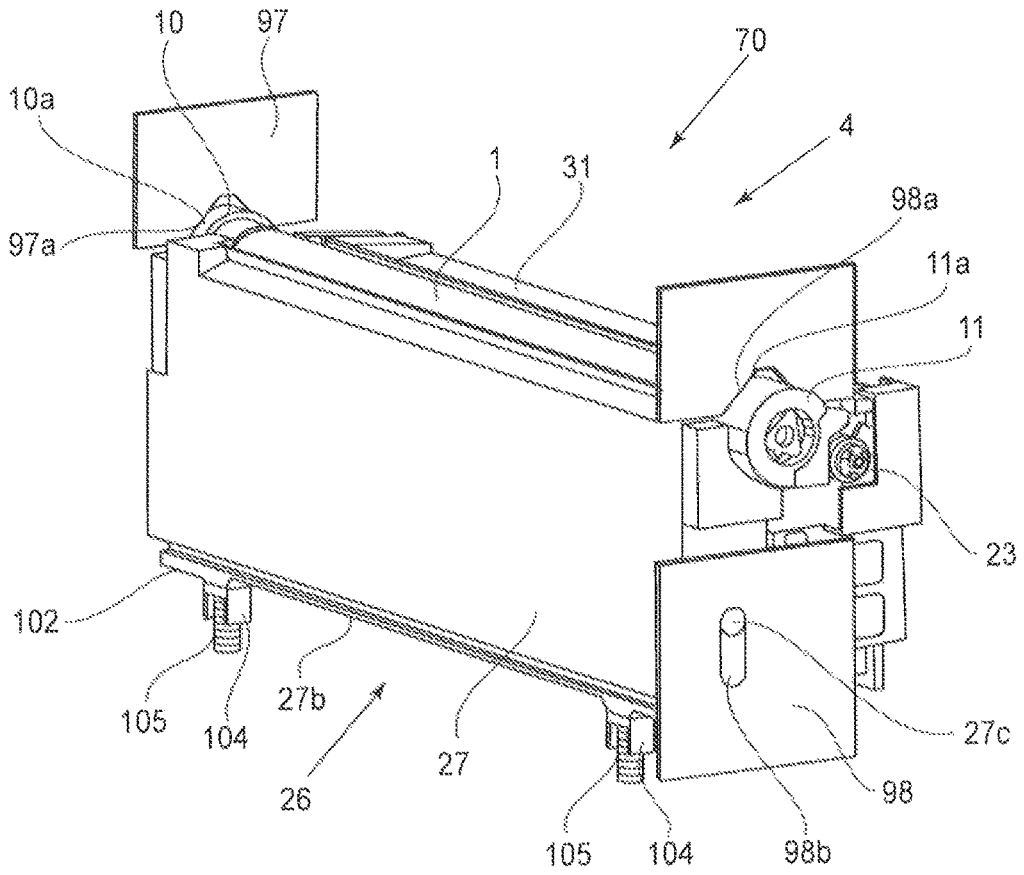
FIG. 8 is a perspective view showing a state in which the process cartridge is positioned to the image forming apparatus main assembly in the embodiment of the present invention.

FIG. 7(*d*) and FIG. 8 are schematic views for illustrating a state in which the process cartridge 70 is positioned relative to the apparatus main assembly 100A. In a state of (c) of FIG. 7, in interrelation with closing of a front door 96 of the apparatus main assembly 100A, the main assembly lower mounting guide portion 102 including the main assembly pressing member 104 and the main assembly pressing spring 105 moves upward with respect to the vertical direction of the image forming apparatus 100. With the movement, also a cartridge(-side) positioning portion 11*a* provided at an upper portion of the rear drum bearing 11 contacts an abutting portion 98*a* which is a main assembly (-side) positioning portion of the rear plate 98.

Then, by the contact of the cartridge positioning portion 11*a* provided at the upper portion of the rear drum bearing 11 with an abutting portion 97*a* which is a main assembly (-side) positioning portion of a front plate 97, the position of the process cartridge 70 relative to the apparatus main assembly 100A is determined. Also in this state, the guide portion 27*b* of the frame 27 is spaced from the guide surface of the main assembly lower mounting guide portion 102, so that the process cartridge 70 is in a state in which the process cartridge 70 is pressed by a spring force, of the main assembly pressing spring 105, received from the main assembly pressing member 104.

Further, the frame 27 is provided on a side surface thereof with a boss 27*c* as a rotation stopper for the process cartridge 70, and the boss 27*c* engages with a rotation preventing hole (portion) 98*b* provided in the rear plate 98. Thus, the process cartridge 70 is prevented from rotating in the apparatus main assembly 100A.

(Spacing Mechanism Between Photosensitive Drum and Developing Roller in Process Cartridge)

In the process cartridge 70 according to this embodiment, the photosensitive drum 1 and the developing roller 25 are capable of being contacted to and spaced from each other. Here, a contact and separation (spacing) mechanism between the photosensitive drum 1 and the developing roller 25 will be described with reference to FIGS. 9 and 10.

Figure 9:
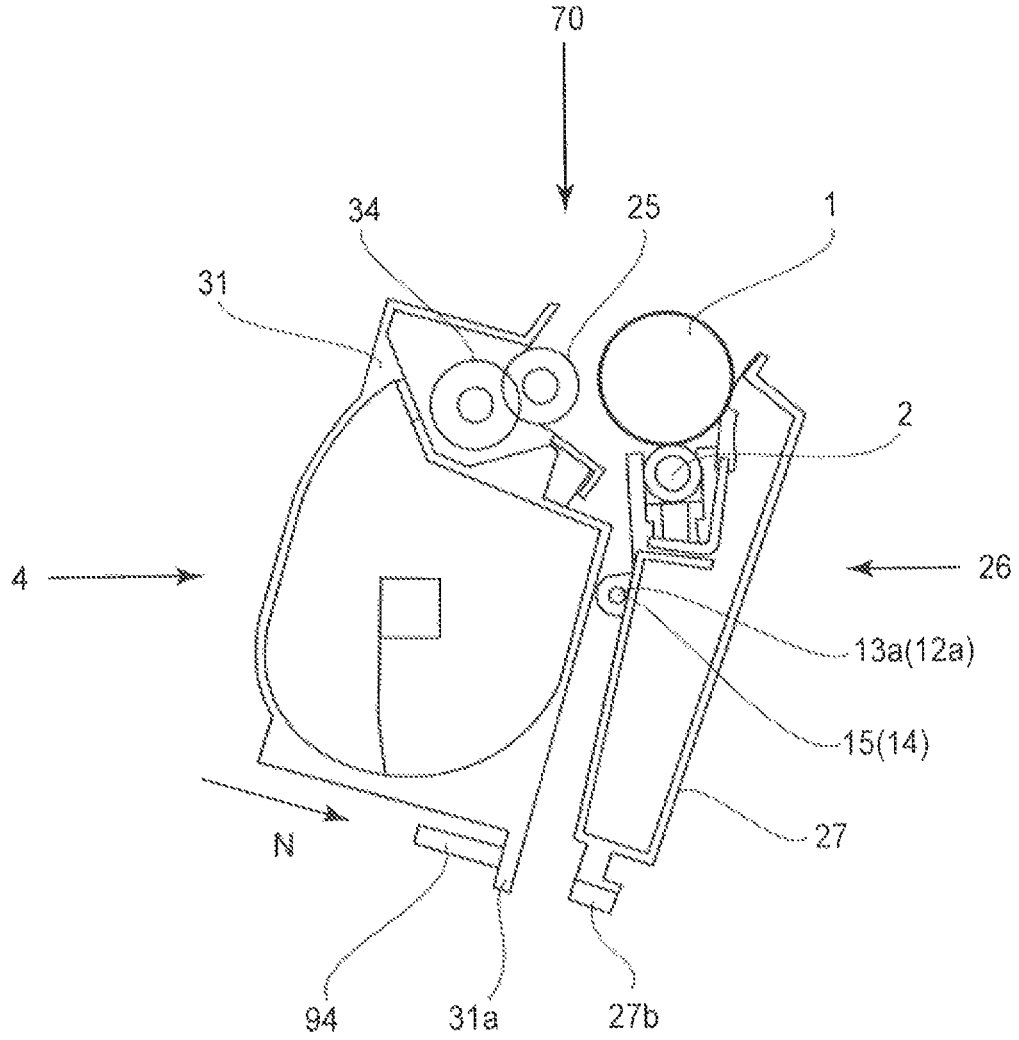
FIG. 9 is a sectional view for illustrating a spacing operation of the developing unit in the embodiment of the present invention.

In FIG. 9, the apparatus main assembly is provided with a spacing member 94 at a predetermined position with respect to a longitudinal direction of the process cartridge 70. A spacing force receiving portion 31*a* of the developing frame 31 receives a force from the spacing member 94 moving in an arrow N direction, whereby the developing unit 4 of the process cartridge 70 moves the developing roller 25 to a spaced position where the developing roller 25 is spaced from the photosensitive drum 1.

Figure 10:
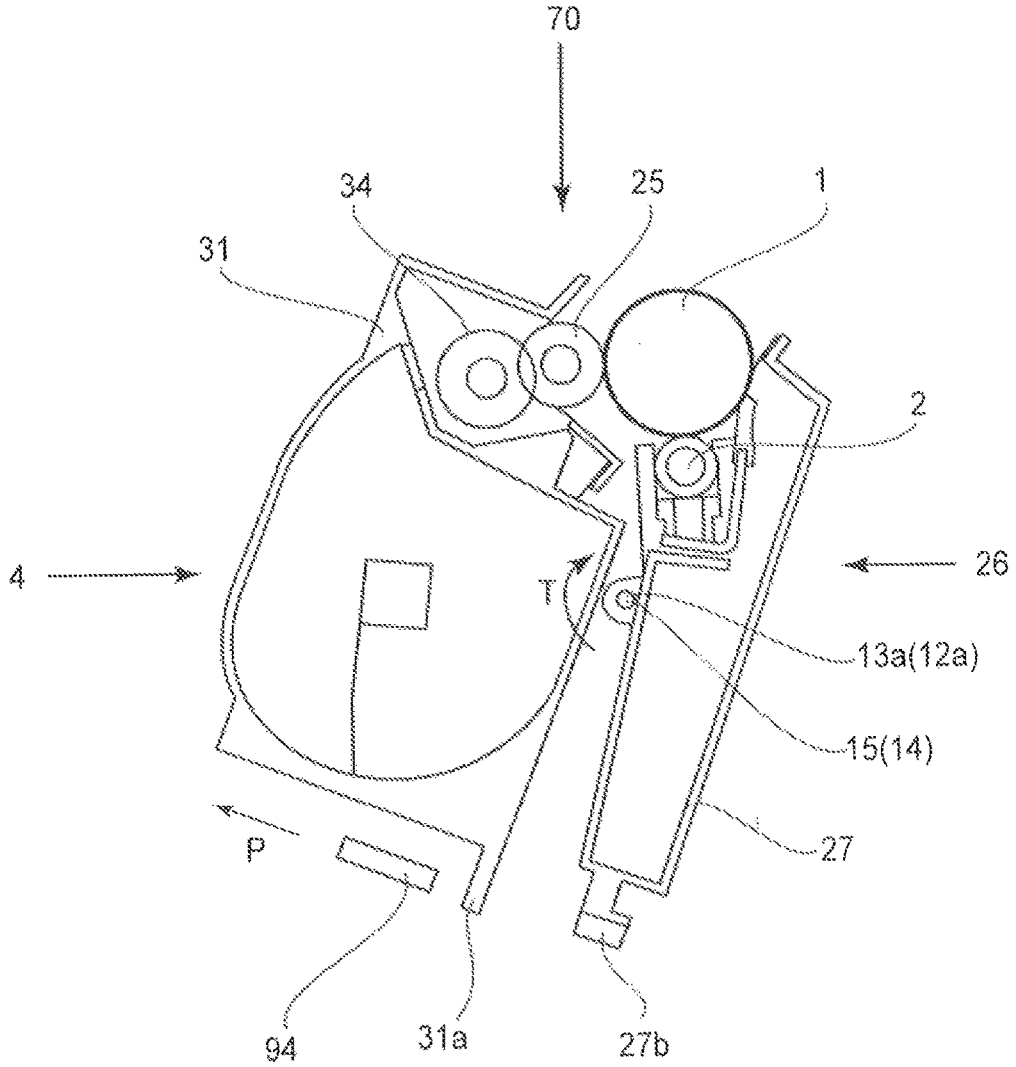
FIG. 10 is a sectional view for illustrating a contact operation of the developing unit in the embodiment of the present invention.

Further, as shown in FIG. 10, when the spacing member 94 moves in an arrow P direction away from the spacing force receiving portion 31*a*, the developing unit 4 is rotated in an arrow T direction about the holes 12*a* and 13*a* of the front and rear developing bearings 12 and 13 by the urging force of the urging springs 32 (FIG. 5) provided at the ends of the developing frame 31. Then, the developing unit 4 is moved to a contact position, so that the developing roller 25 and the photosensitive drum 1 are in contact with each other. By this contact and separation mechanism, during the image formation, the developing unit 4 is moves to a contact position, and when the image formation is not effected, the developing unit 4 moves to and is held at the spaced position. By that, an effect of suppressing the influence of deformation of the developing roller 25 on an image quality is obtained.

(Spacing Mechanism when Process Cartridge is Mounted)

Figure 11:
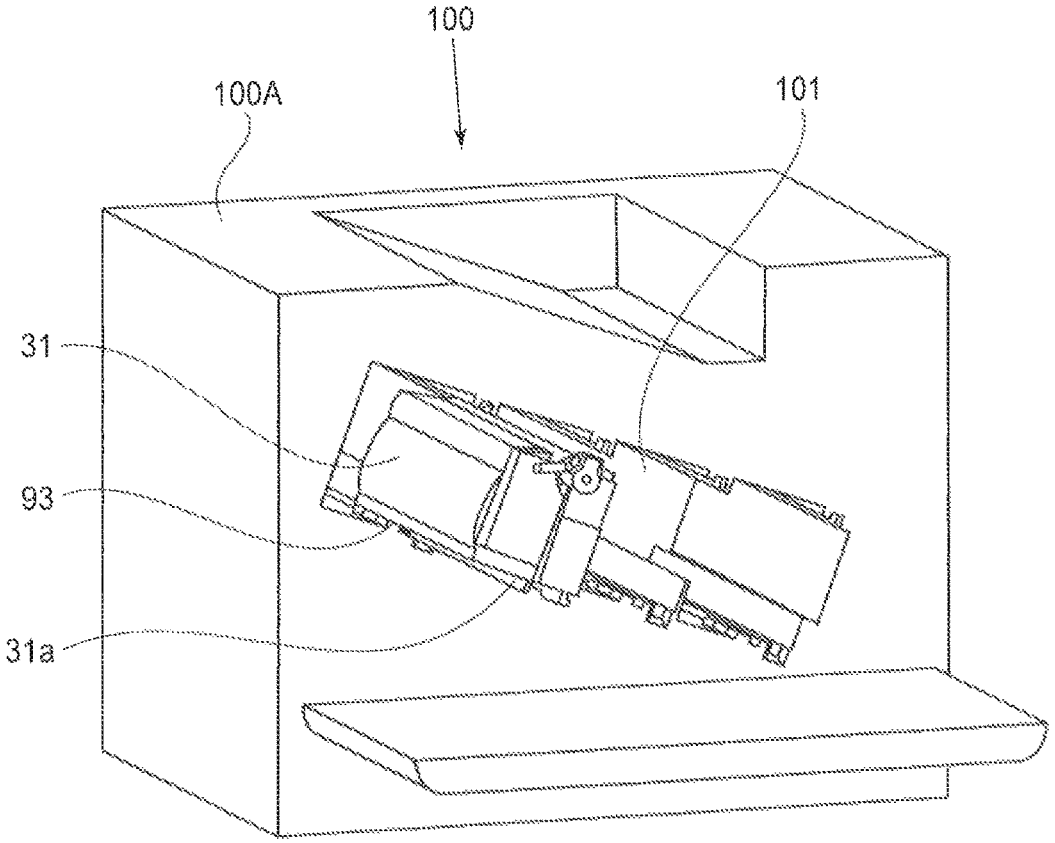
FIG. 11 is a perspective view before the process cartridge is mounted in the image forming apparatus main assembly in the embodiment of the present invention.
Figure 12:
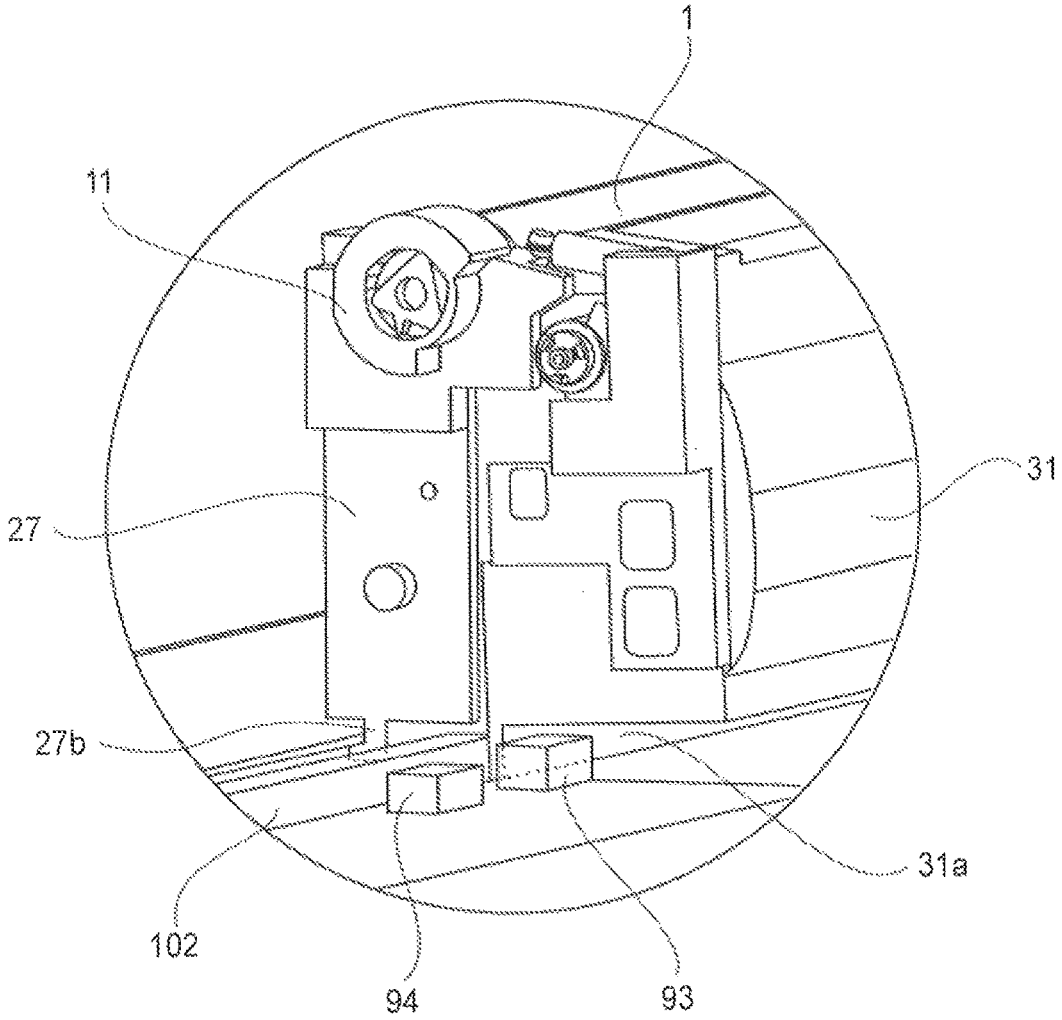
FIG. 12 is a perspective view of mounting of the process cartridge in the image forming apparatus main assembly in the embodiment of the present invention.

The contact and separation mechanism when the process cartridge 70 is mounted in the apparatus main assembly 100A will be described using FIGS. 11 and 12.

When the process cartridge 70 is mounted in the apparatus main assembly 100A, the developing unit 4 is in the contact portion, and the photosensitive drum 1 and the developing roller 25 are in contact with each other. At the time of completion of the mounting of the process cartridge 70 in the apparatus main assembly 100A and at the time of end of the image forming operation of the image forming apparatus 100, the developing unit 4 is in the spaced position, and the photosensitive drum 1 and the developing roller 25 are spaced from each other.

Therefore, when the process cartridge 70 is mounted in the apparatus main assembly 100A, there is a need to move the process cartridge 70 from the contact position to the spaced position, and a constitution thereof will be described using FIGS. 11-14. As shown in FIG. 11, the apparatus main assembly 100A is provided with an image forming apparatus opening 101 for permitting mounting of the process cartridge 70. Further, as shown in FIGS. 11 and 12, the apparatus main assembly 100A is provided with a spacing guide portion 93 contacting a spacing force receiving portion 31*a* provided on the developing unit 4 of the process cartridge 70.

Figure 13:
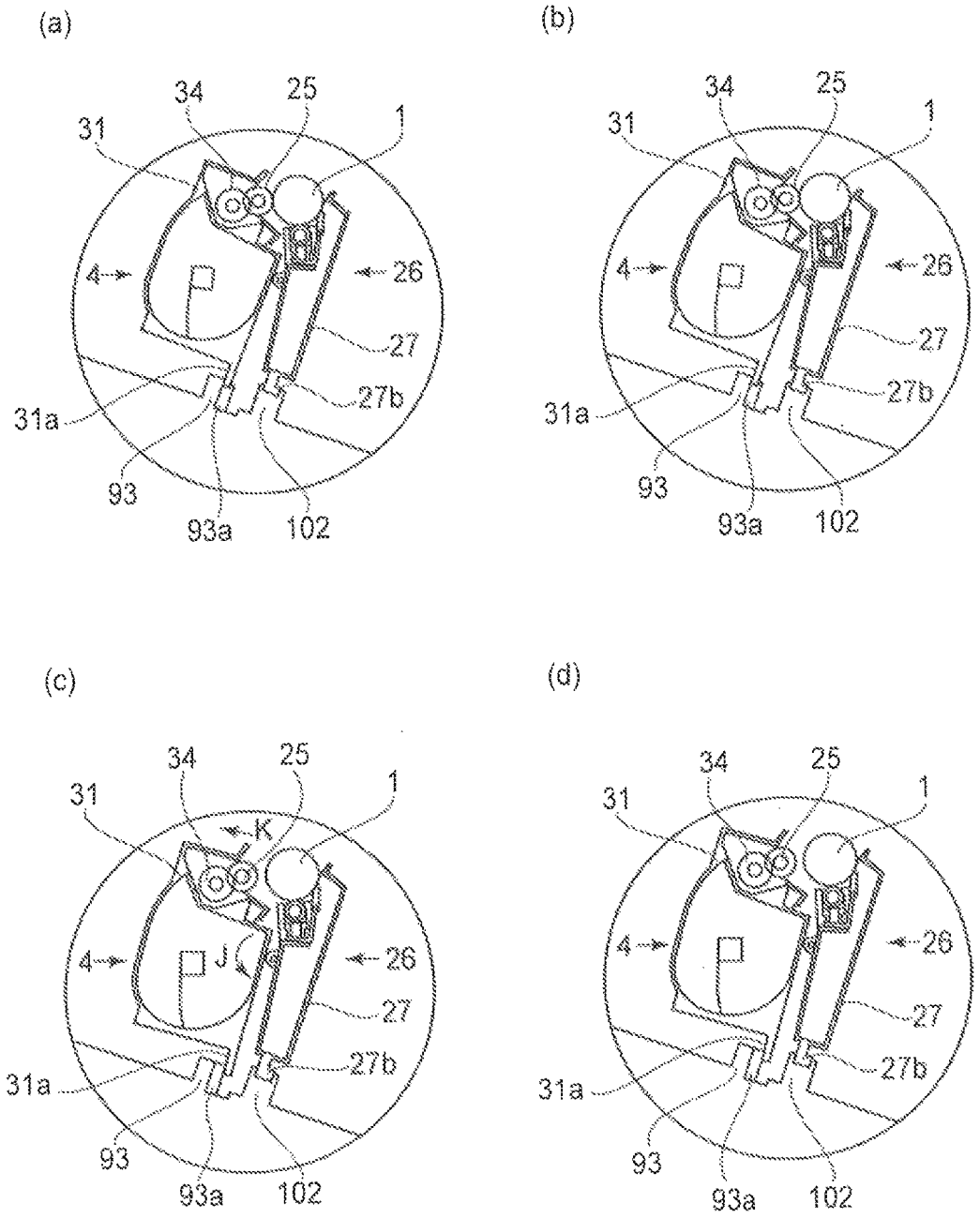
FIG. 13 includes schematic views in which an operation of mounting the process cartridge in the image forming apparatus main assembly is viewed from an apparatus main assembly front side in the embodiment of the present invention.
Figure 14:
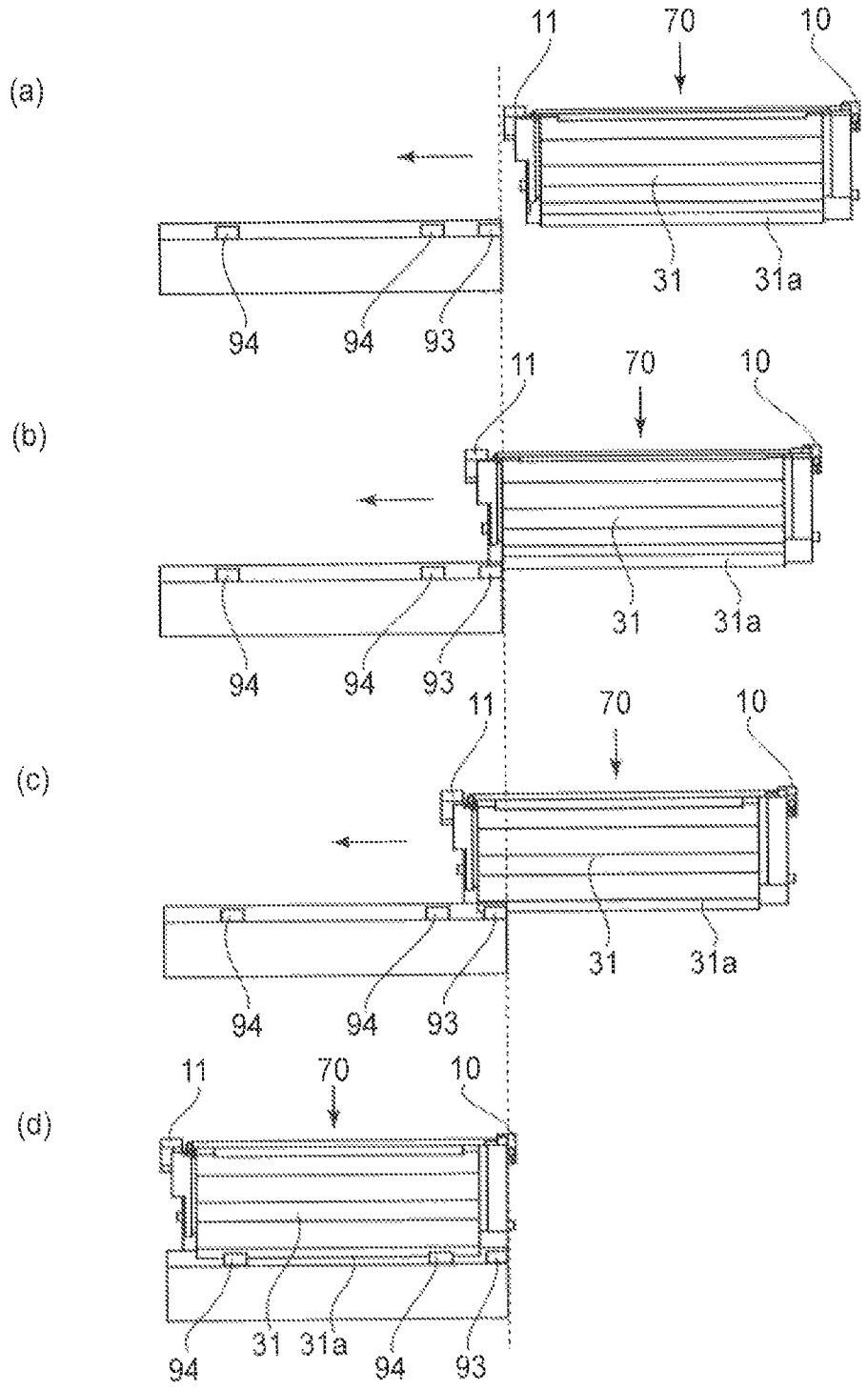
FIG. 14 includes schematic views in which the position of mounting the process cartridge in the image forming apparatus main assembly is viewed from an apparatus main assembly side surface side in the embodiment of the present invention.

As shown in (a) of FIG. 13 and (a) of FIG. 14, before the process cartridge 70 enters the apparatus main assembly 100A, the developing unit 4 is in the contact position, and the photosensitive drum 1 and the developing roller 25 are in contact with each other. Then, as shown in (b) of FIG. 13 and (b) of FIG. 14, when the process cartridge 70 is mounted into the apparatus main assembly 100A, first, the guide portion 27*b* provided integrally with the frame is mounted on the main assembly lower mounting guide portion 102 provided in the apparatus main assembly 100A. Then, the spacing force receiving portion 31*a* provided on the developing frame 31 contacts a chamfered portion 93*a* which is an inclined surface obliquely inclined relative to the spacing guide portion 93.

When the process cartridge 70 is caused to further enter the apparatus main assembly, as shown in (c) of FIG. 13 and (c) of FIG. 14, the spacing force receiving portion 31*a* moves along the chamfered portion 93*a*, so that the developing unit 4 rotates in an arrow J direction about a rear supporting pin 15 as a rotation center. Then, the developing unit 4 moves in an arrow K direction to the spaced position. Then, when the process cartridge 70 is positioned in the apparatus main assembly 100A, as shown in (d) of FIG. 13 and (d) of FIG. 14, the spacing force receiving portion 31*a* is in a contact state with the spacing member 94 disposed downstream of the spacing guide portion 93 with respect to the mounting direction. At that time, the developing unit 4 is in the spaced position, so that the process cartridge 70 can be mounted in the apparatus main assembly 100A while keeping the developing roller 25 in the spaced state from the photosensitive drum 1.

(Constitution of Photosensitive Drum Driving Mechanism, Developer Supplying Roller Supporting and Developing Coupling Portion in Process Cartridge)

Next, a constitution of a coupling portion in the developing unit 4, the developer supplying roller 34 which is a rotatable member, and a supporting constitution of the developer supplying roller 34 according to this embodiment will be described using FIGS. 15-18.

Figure 15:
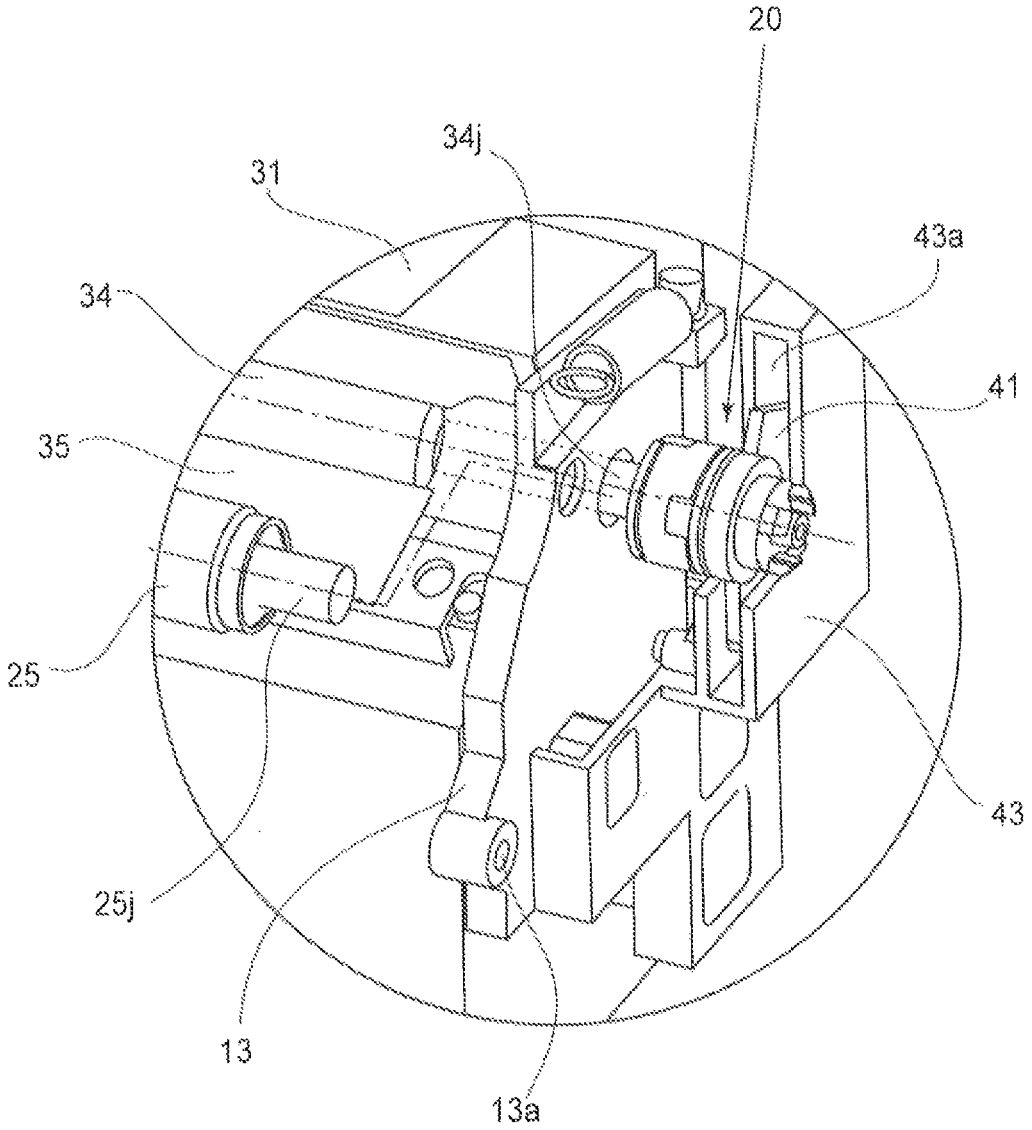
FIG. 15 is a perspective view for illustrating a supporting constitution for a developer supplying roller and a developing roller in the embodiment of the present invention.

FIG. 15 is an illustration showing a longitudinal one end side (rear side) of a supporting portion for the developing roller 25 and the developer supplying roller 34. In FIG. 15, a developing roller shaft 25*j* of the developing roller 25 and a developer supplying roller shaft 34*j* of the developer supplying roller 34 are rotatably engaged with an inner peripheral surface of the rear developing bearing 13. Here, the supporting constitution in the longitudinal one end side of the developing roller 25 and the developer supplying roller 34 was described, but also in the other longitudinal one end side, similarly, the bearing portion is integrally provided with the bearing member, and the developing roller shaft 25*j* and the developer supplying roller shaft 34*j* are rotatably engaged in the other end side. Further, at the coupling portion, an contact 20 which is a shaft coupling member is used. In this embodiment, a constitution in which each of the developer supplying roller 34 and the developing roller 25 is supported by the developing unit 4 is employed. For that reason, the developer supplying roller 34 and the developing roller 25 are always in contact with each other independently of the contact or spaced state between the photosensitive drum 1 and the developing roller 25.

Figure 16:
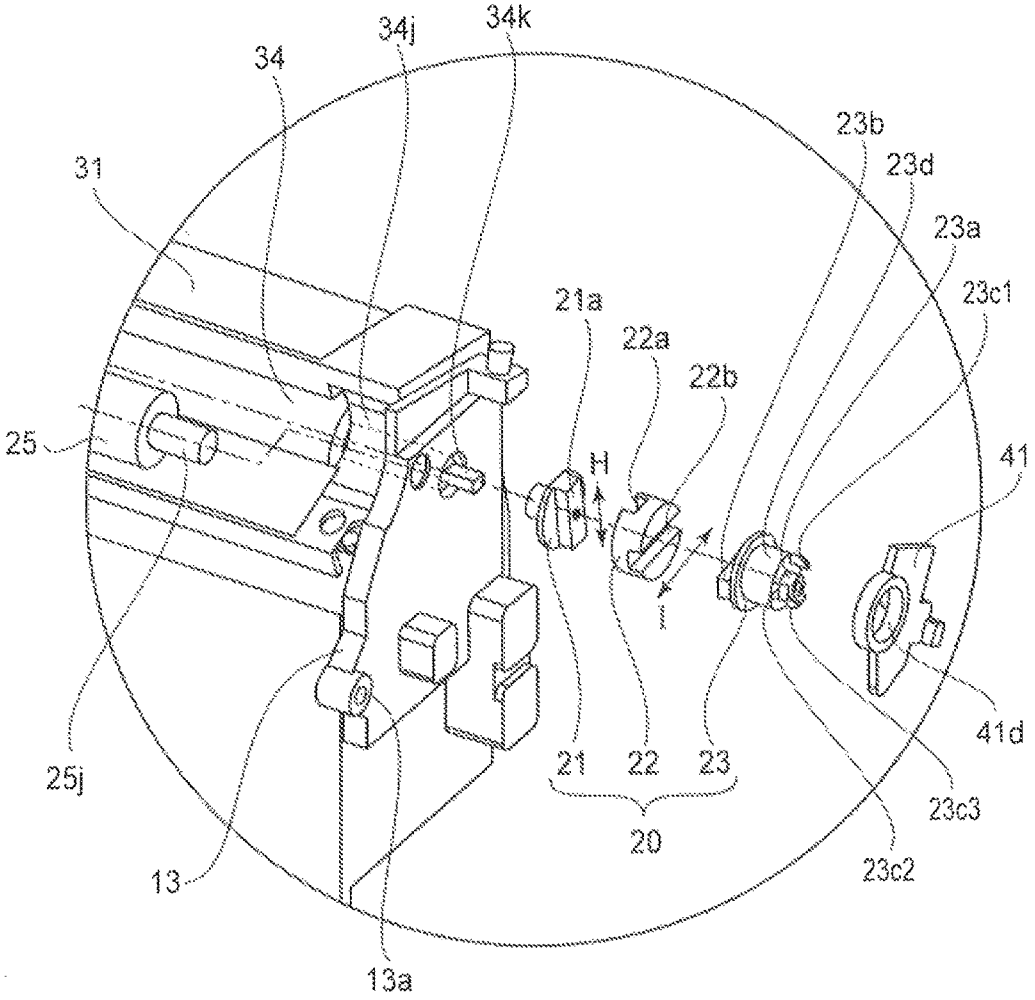
FIG. 16 is an exploded illustration of a shaft coupling member in the embodiment of the present invention.

Using FIG. 16, a constitution of the Oldham coupling 20 will be described. Here, in order to describe the constitution of the Oldham coupling 20, the rear developing bearing 13 is not shown. As shown in FIG. 16, the Oldham coupling 20 is constituted by a follower-side engaging portion 21 as a driven portion, an intermediary engaging portion as an intermediary portion, and a driving-side engaging portion 23 as a drive receiving portion.

The follower-side engaging portion 21 is fixed and mounted a shaft 34*j* of the developer supplying roller 34 in one end side with respect to an axial direction. As a fixing method, there are a method in which connection is made by a spring pin or a parallel pin and a method in which as shown in FIG. 16, the developer supplying roller shaft 34*j* is provided with a cut portion 34*k* at an end surface thereof and also a hole in the follower-side engaging portion 21 side is similarly shape and is engaged with the cut portion 34*k*.

The driving-side engaging portion 23 is a portion for receiving a difference of a driving source of the main assembly. Further, a shaft portion 23*d* of the driving-side engaging portion 23 is rotatably held in a hole 41*d* of a holding portion 41. This holding portion is movable in a direction perpendicular to the axial direction of the developing roller. Further, the driving-side engaging portion 23 is integrally formed with three projections 23*c*1, 23*c*2 and 23*c*3 engageable with a main assembly(-side) developing (means) coupling 91 (FIG. 18) which is a second main assembly(-side) drive transmitting member of the 100A described later.

This Oldham coupling 20 allows a deviation between an axis of the main assembly developing coupling 91 which is a difference providing driving member provided in the main assembly and an axis of the developer supplying roller 34, and transmits a rotational difference (second rotational difference) from the apparatus main assembly 100A to the developer supplying roller 34. Further, the Oldham coupling 20 is capable of transmitting a rotational difference (second rotational difference) from the apparatus main assembly 100A to the developer supplying roller 34 in a state in which the developing unit 4 is in the contact position and in the spaced position.

Figure 17:
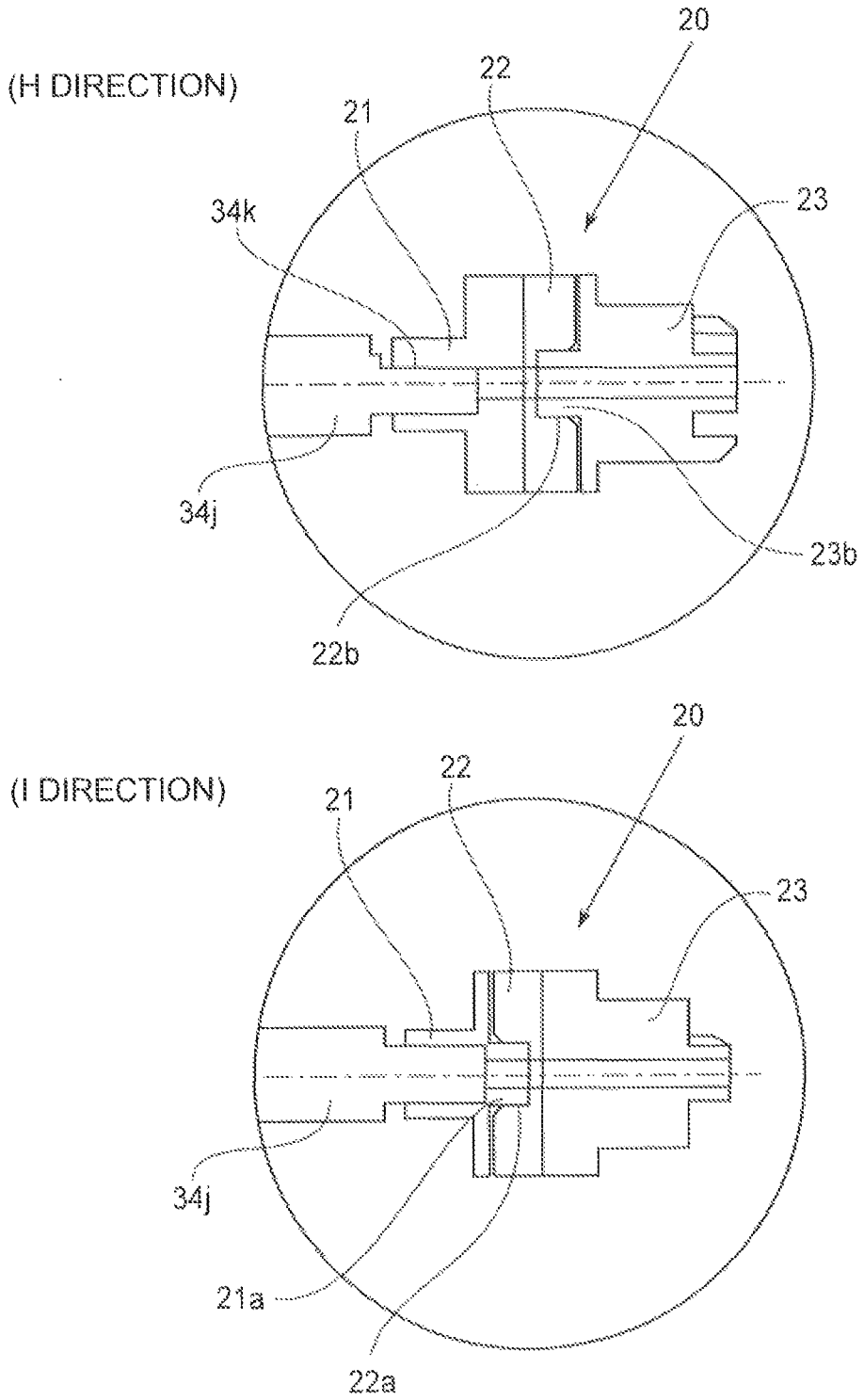
FIG. 17 includes sectional illustrations of the shaft coupling member in the embodiment of the present invention.

In FIG. 17, a constitution of the Oldham coupling 20 will be described in further detail using sectional views. FIG. 17(*a*) is a sectional view of the Oldham coupling 20 cut in parallel to an arrow H direction in FIG. 16, and FIG. 17(*b*) is a schematic view of the Oldham coupling 20 cut in parallel to an arrow I direction in FIG. 16. In (a) of FIG. 17, the follower-side engaging portion 21 is integrally provided with a rib 21*a*. The intermediary engaging portion 22 is provided with a groove 22*a*, and the rib 21*a* and the groove 22*a* are engaged with each other so as to be movable in the arrow H direction of FIG. 16. In (b) of FIG. 17, the driving-side engaging portion 23 is integrally provided with a rib 23*b*. The intermediary engaging portion 22 is provided with a groove 22*b*, and the rib 23*b* and the groove 22*b* are engaged with each other so as to be movable in the arrow I direction of FIG. 16. In this embodiment, the H direction and the I direction are in the substantially perpendicular relationship.

The intermediary engaging portion 22 engages with the follower-side engaging portion 21 and the driving-side engaging portion 23, and constitutes an intermediary portion for transmitting a difference, inputted into the driving-side engaging portion 23, to the follower-side engaging portion 21, and is movable in a direction crossing the axial direction of the developer supplying roller 34 while maintaining engagement with each of the engaging portions 21 and 23.

Figure 18:
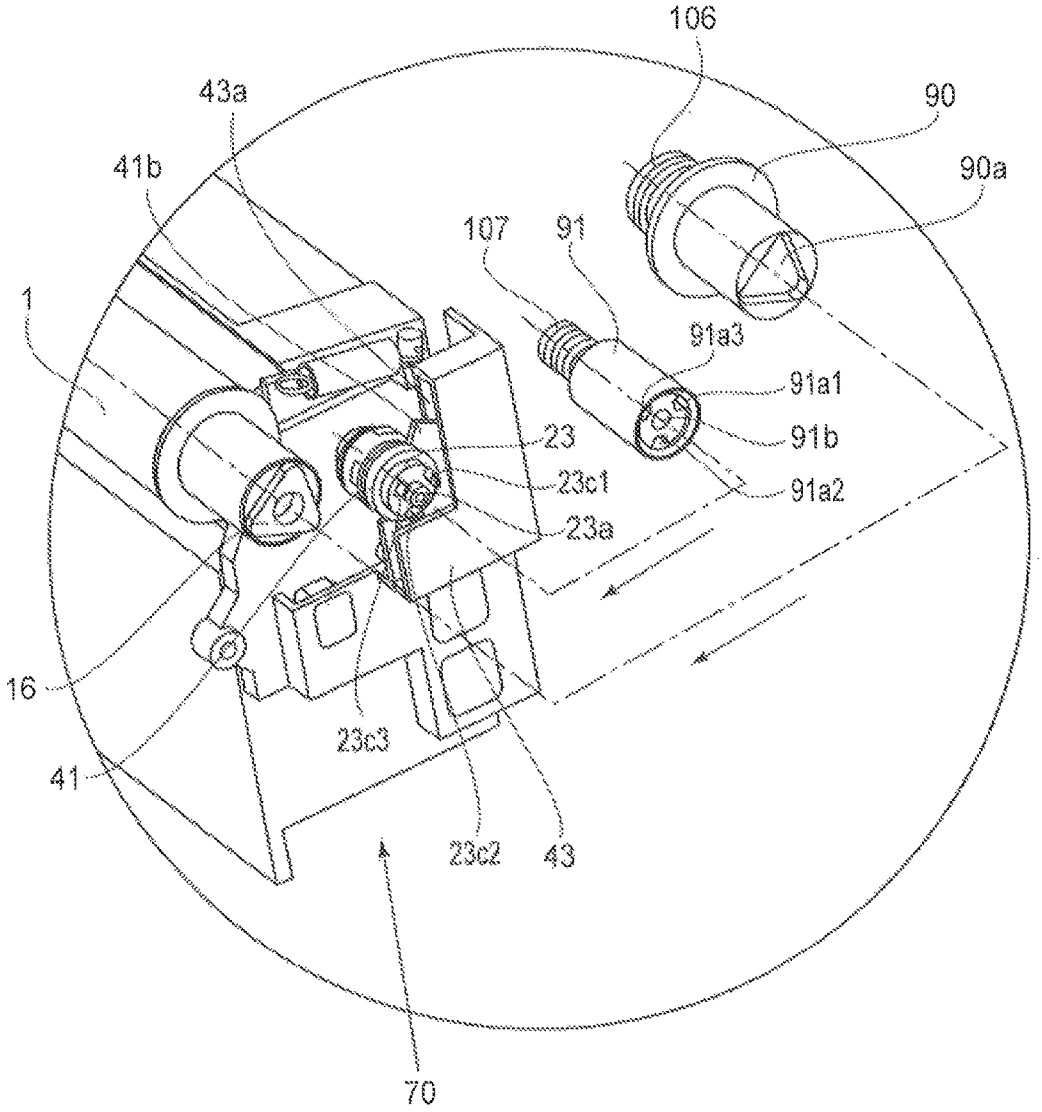
FIG. 18 is a perspective view for illustrating the shaft coupling member in a developing unit state and a first main assembly driving member and a second main assembly driving member of the image forming apparatus main assembly in the embodiment of the present invention.

FIG. 18 is an illustration showing a constitution including the coupling provided on the process cartridge 70 and the coupling provided in the apparatus main assembly 100A. As described above, at the end surface of the driving-side engaging portion 23 of the Oldham coupling 20 provided on the developing chamber 4, the three projections 23*c*1, 23*c*2 and 23*c*3 projecting in the axial direction are formed. Further, a centering boss 23*a* to be aligned with the axis (rotation enter) of the main assembly developing coupling 91 projects in the axial direction from the end surface of the driving-side engaging portion 23.

A guide portion 41*b* of the holding portion 41 is movable, in a direction crossing the axial direction of the developer supplying roller 34, along the groove 43*a* of the side cover 43 fixed on the developing unit with an unshown screw or the like. That is, the driving-side engaging portion 23 is movable in the direction crossing the axial direction of the developer supplying roller.

In one end side of the photosensitive drum 1 with respect to the axial direction, a triangular drum coupling 16 which is a drum coupling portion is provided. In this embodiment, the drum coupling 16 is formed integrally with the flange of the photosensitive drum. In FIG. 18, the main assembly drum coupling 90 which is a drum driving member (first main assembly drive transmitting member) for transmitting the drive of the apparatus main assembly 100A to the photosensitive drum 1 is provided with a hole 90*a* having a substantially triangular shape in cross section. The main assembly developing coupling 91 which is a driving member for providing the difference (second rotational difference) from the apparatus main assembly 100A to the developer supplying roller 34 is provided with three holes 91*a*1, 91*a*2 and 91*a*3.

The main assembly drum coupling 90 is urged in a direction of the process cartridge 70 by a drum pressing (urging) member 106 such as a compression spring. Further, the main assembly drum coupling 90 is movable in the axial direction of the photosensitive drum 1. Further, in the case where the drum coupling 16 and the hole 90*a* of the main assembly drum coupling 90 are out of phase and in contact with each other when the process cartridge 70 is mounted in the apparatus main assembly 100A, the main assembly drum coupling 90 is pushed by the drum coupling 16, thus being retracted. Then by rotation of the main assembly drum coupling 90, the drum coupling 16 and the hole 90*a* are engaged with each other, the rotational difference is transmitted to the photosensitive drum 1.

Further, the main assembly developing coupling 91 is urged in the direction of the process cartridge 70 toward a direction parallel to the axial direction of the photosensitive drum 1 by a developing (means) pressing (urging) member 107 such as a compression spring. However, the main assembly developing coupling 91 has no play with respect to the direction crossing the axial direction and is provided in the apparatus main assembly 100A. That is, the main assembly developing coupling 91 not only rotates for transmitting the drive (difference) but also in movable only in the axial direction.

When the driving-side engaging portion 23 and the main assembly developing coupling 91 are engaged with each other by causing the process cartridge 70 to enter the apparatus main assembly 100A, the projections 23*c*1-23*c*3 and the holes 91*a*1-91*a*3 are out of phase in some cases. In this case, free ends of the projections 23*c*1-23*c*3 contact portions other than the holes 91*a*1-91*a*3, so that the main assembly developing coupling 91 is retracted in the axial direction against an urging force of the developing pressing member 107. However, when the main assembly developing coupling 91 rotates and the projections 23*c*1-23*c*3 and the holes 91*a*1-91*a*3 are in phase, the main assembly developing coupling 91*a* advances by the urging force of the developing pressing member 107.

Then, the projections 23*c*1-23*c*3 and the holes 91*a*1-91*a*3 engage with each other, and also the centering boss 23*a* which is an engaging portion positioning portion and the centering hole 91*b* which is a transmitting member positioning portion engage with each other, so that the driving-side engaging portion 23 and the axis (rotation center) of the main assembly developing coupling 91 coincide with each other. Then, by rotation of the main assembly coupling 91, the projections 23*c*1-23*c*3 and the holes 91*a*1-91*a*3 engage with each other, respectively, so that the rotational difference is transmitted to the developer supplying roller 34. Next, rotation of the developing roller 25 will be described. The developer supplying roller 34 is provided with the driving-side engaging portion 23 in one end side and is provided with a first gear in the other end side with respect to the longitudinal direction (the axial direction of the developer supplying roller, the axial direction of the developing roller). Incidentally, in this embodiment, the axial direction of the developer supplying roller and the axial direction of the developing roller are is a substantially parallel relationship. On the other hand, the developing roller 25 is provided with a second gear engageable with the above gear. By this constitution, the rotational difference is transmitted to the developing roller 25 drive-connected to the developer supplying roller 34 by the gears in the other end side with respect to the longitudinal direction.

Here, the drive transmission to the main assembly drum coupling 90 and the main assembly developing coupling 91 is made by a motor provided in the apparatus main assembly 100A. By this, the photosensitive drum 1 and the developer supplying roller 34 receive the difference from the image forming apparatus main assembly independently of each other. Incidentally, the motor may employ a constitution using a single motor per each of the process cartridges 70 for the respective colors and a constitution in which the drive is transmitted to some process cartridges by the single motor.

(Operation of Contact During Contact and Separation Operation in Process Cartridge)

Next, an operation of the contact 20 during a contact and separation operation between the developing roller and the photosensitive drum in the process cartridge 70 according to this embodiment will be described using FIGS. 1, 19 and 20.

Figure 19:
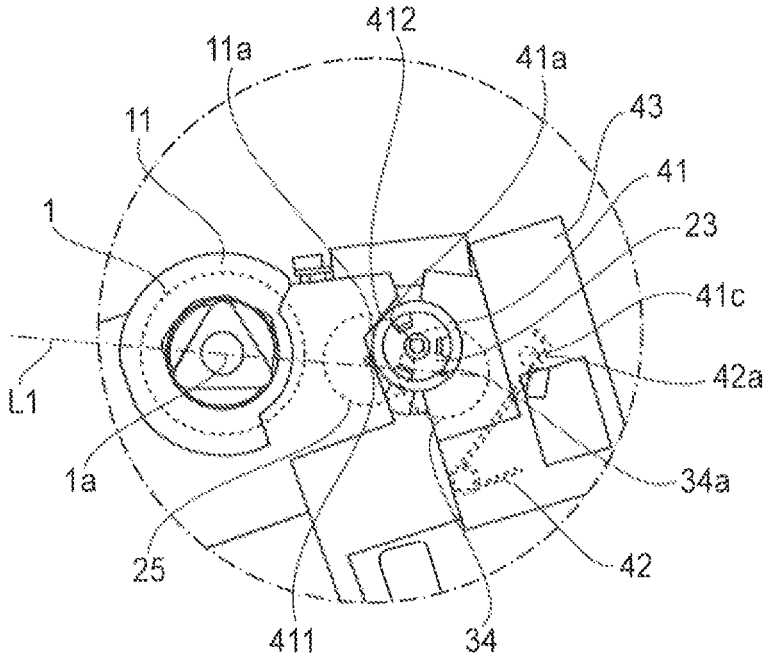
FIG. 19 includes a side view and a sectional view for illustrating an operation of shaft coupling members when the developing unit is in a spaced state and a driving-side engaging portion and a main assembly developing coupling do not engage with each other in an embodiment of the present invention.
Figure 19:
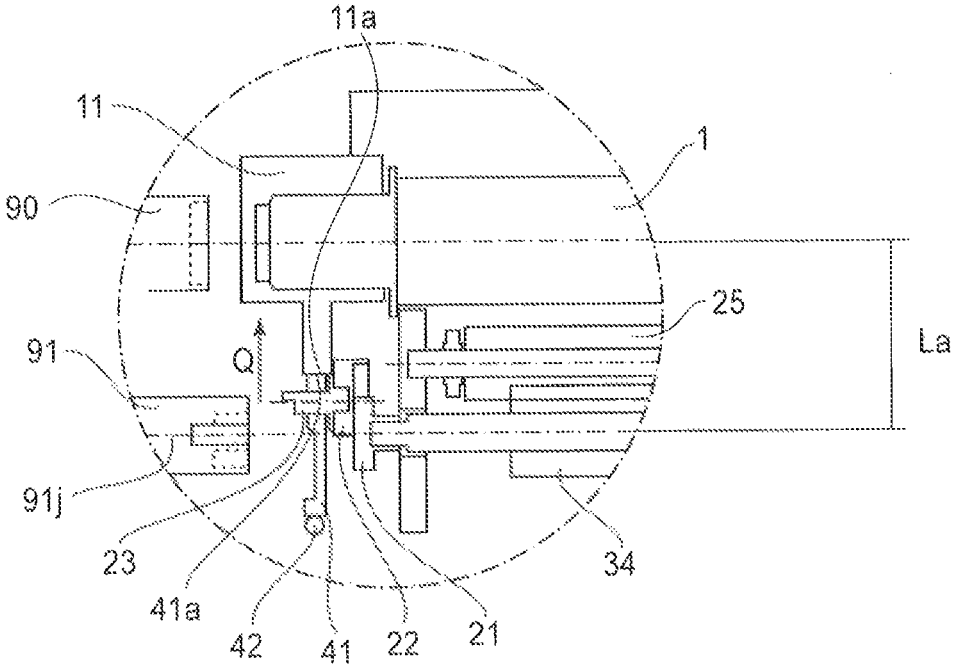

FIG. 19 includes a side view and a longitudinal sectional view which show a state in which the developing unit 4 is positioned in the spaced position. In a state in which the developing unit is positioned in the spaced position by a spacing guide portion 93, as shown in FIG. 19, the developing roller 25 and the photosensitive drum 1 are in a spaced state.

However, an arm portion 42*a* of an urging spring 42 which is an urging member constituted by a helical coil spring provided in a side cover 43 contacts a locking portion 41*c* of the holding portion 41. By that, the driving-side engaging portion 23 is urged in a direction Q (direction toward the develop) crossing the axial direction of the photosensitive drum 1. Then, a contact portion 41*a* of the holding portion 41 contacts a bearing contact portion 11*a* which is an abutting portion (stopping portion) provided on the rear drum bearing 11, and engages with the bearing contact portion 11*a*.

Here, the bearing contact portion 11*a* of the rear drum bearing 11 has a V-character shape. Then, the bearing contact portion 11*a* is formed by two surfaces (sides) parallel to the axis of the photosensitive drum 1 with respect to the axial direction of the photosensitive drum 1. Further, by the contact of the holding portion 41 with this bearing contact portion 11*a*, the holding portion 41 can be held in parallel to the axis of the photosensitive drum 1. Further, the rear drum 11 is provided with the cartridge positioning portion 11*a* as a unit. Accordingly, the driving-side engaging portion 23 rotatably supported by the holding portion 41 is positioned with accuracy relative to the rear plate 98, of the apparatus main assembly 100A, to which the cartridge positioning portion 11*a* is to be positioned. Accordingly, the driving-side engaging portion 23 can be positioned with accuracy also relative to an axis 91*j* of the main assembly developing coupling 91 provided in the apparatus main assembly 100A.

Incidentally, in this embodiment, as the member for urging the holding portion 41, the urging spring 42 was used. However, an elastically deformable elastic portion is provided integrally with the holding portion 41 and thus may also be contacted to the bearing contact portion 11*a*.

Next, when the driving-side engaging portion 23 engages with the main assembly developing coupling 91 and then rotates, the driving-side engaging 23 is positioned by the main assembly developing coupling 91. At this time, a constitution in which the contact portion 41*a* of the holding portion 41 is spaced from the rear drum bearing 11, i.e., the bearing contact portion 11*a* is formed.

For that reason, when the contact 70 enters the apparatus main assembly 100A, an axis 23*j* of the driving-side engaging portion 23 will start engagement in a state in which the axis 23*j* is deviated from the axis 91*j* of the main assembly developing coupling 91 toward the photosensitive drum 1 side by a certain distance. From this state, when the process cartridge 70 further enters the apparatus main assembly 100A, a constitution in which a taper-shaped chambered portion provided at an outer periphery of a free end of the centering boss 23*a* and a chamfered portion provided in the hole 91*b* correspondingly thereto engage with each other while contacting each other, and thus engage with each other while correcting deviation of the axis center is formed.

Then, the main assembly developing coupling 91 rotates, and when the projections 23*c*1-23*c*3 (FIG. 18) of the driving-side engaging portion 23 and the holes 91*a*1-91*a*3 (FIG. 18) of the main assembly developing coupling 91 are in phase with each other, the centering boss 23*a* and the hole 91*b* engage with each other. By that, the axis 23*j* of the driving-side engaging portion 23 and the axis 91*j* of the main assembly developing coupling 91 coincide with each other. Then, the driving-side engaging portion 23 is positioned by the main assembly developing coupling 91, and therefore the holding portion 41 is spaced from the rear drum bearing 11, i.e., the bearing contact portion 11*a*.

Figure 1:
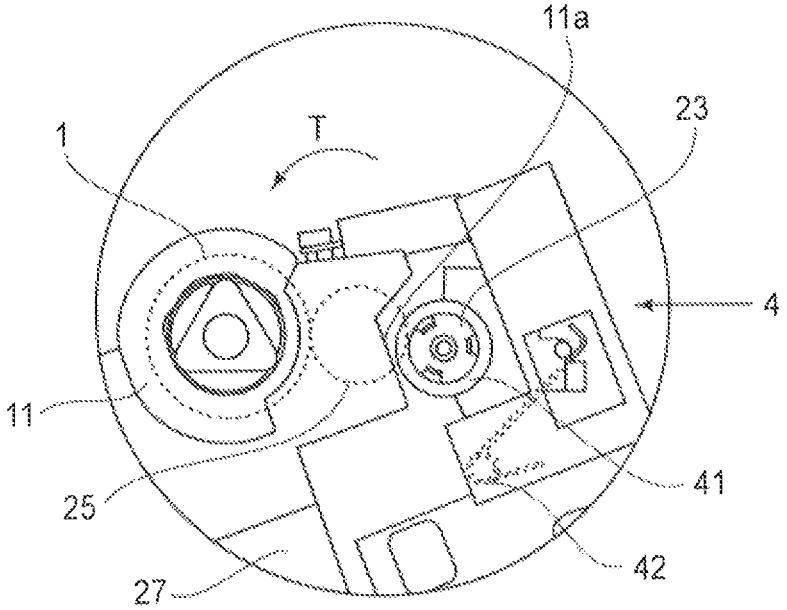
FIG. 1 includes a side view and a sectional view for illustrating an operation of shaft coupling members when a developing unit is in a contact state and a driving-side engaging portion and a main assembly developing coupling engage with each other in an embodiment of the present invention.
Figure 1:
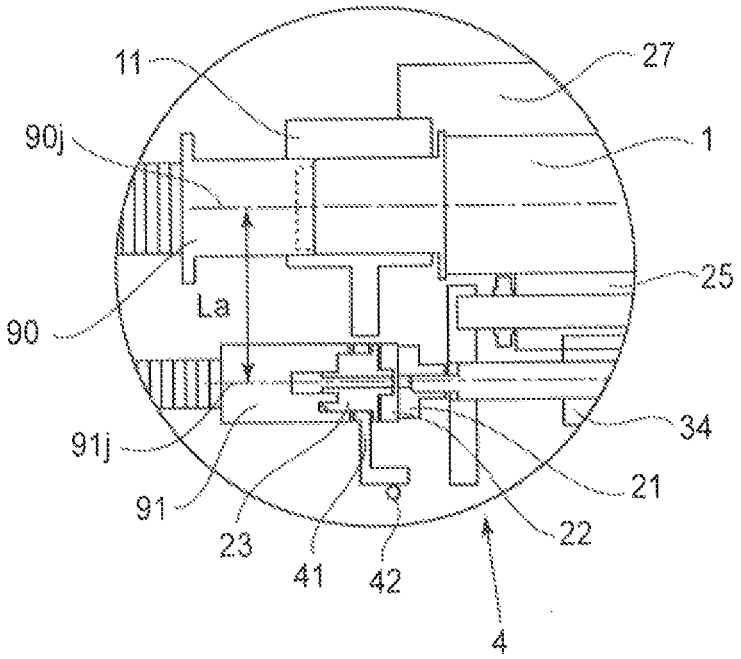

Further, FIG. 1 includes a side view and a longitudinal sectional view which show a state in which the developing unit 4 is positioned in the contact portion. The spacing member 94 (FIG. 10) of the apparatus main assembly 100A operates, so that the developing unit 4 of the process cartridge 70 rotationally moves in an arrow T direction about the rear supporting pin 15 which supports the rear developing bearing 13. Then, the developing unit 4 moves to the contact position, where the develop 1 and the developing roller 25 contact each other. Here, even when the developing unit 4 moves to the contact position, the driving-side engaging portion 23 and the main assembly developing coupling 91 are kept in an engaged state.

Figure 20:
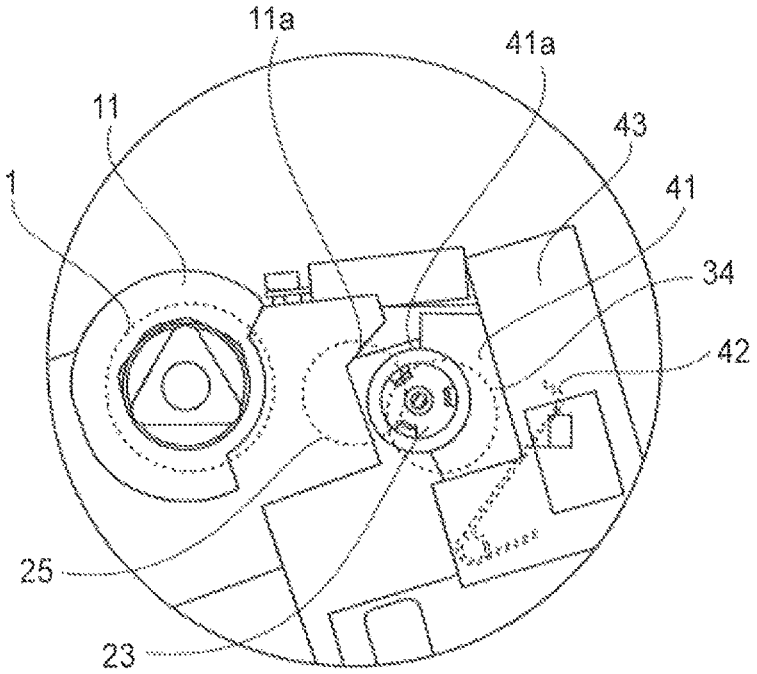
FIG. 20 includes a side view and a sectional view for illustrating an operation of shaft coupling members when the developing unit is in the spaced state and a driving-side engaging portion and a main assembly developing coupling engage with each other in an embodiment of the present invention.
Figure 20:
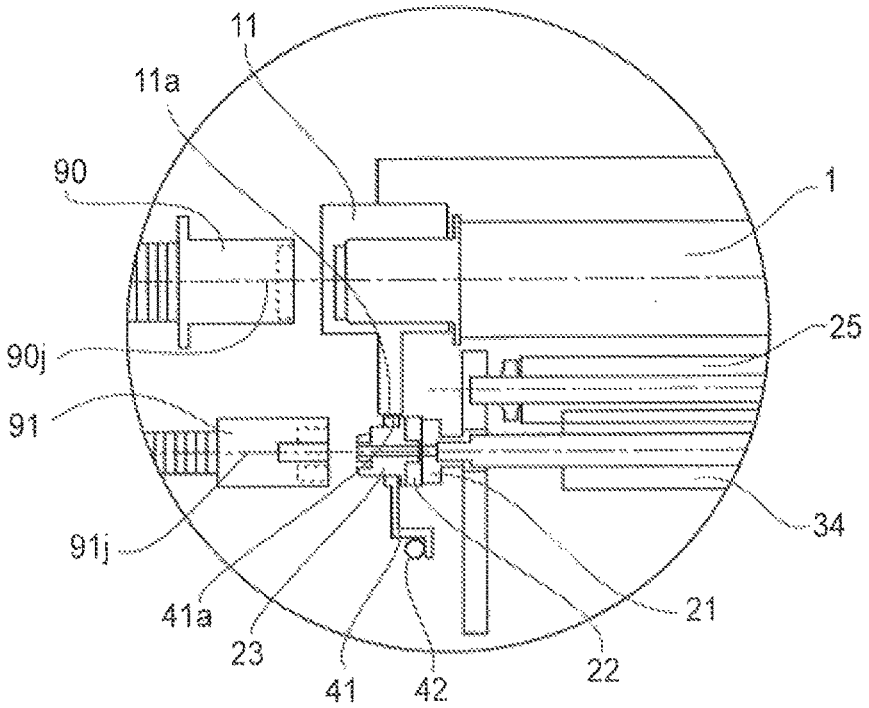

Further, as shown in FIGS. 1 and 20, even in a state of either position of the spaced position and the contact position of the developing unit 4, the intermediary engaging portion 22 engages with the driving-side engaging portion 23 and the follower-side engaging portion 21. Accordingly, the intermediary engaging portion 22 enables movement of the driving-side engaging portion 23 and the follower-side engaging portion 21 while maintaining engagement thereof with the driving-side engaging portion 23 and the follower-side engaging portion 21 also when the developing unit 4 moves between the spaced position and the contact position.

When the intermediary engaging portion 22 rotates while maintaining the engagement with the driving-side engaging portion 23 and with the follower-side engaging portion 21, chips are produced due to the friction at the engaging portions. By this, the friction forces at the engaging portions increase with the result of non-constant rotational speed of the driving-side engaging portion 23 engaged with the main assembly developing coupling 91. This may adversely affect the image produced by the apparatus.

Figure 24:
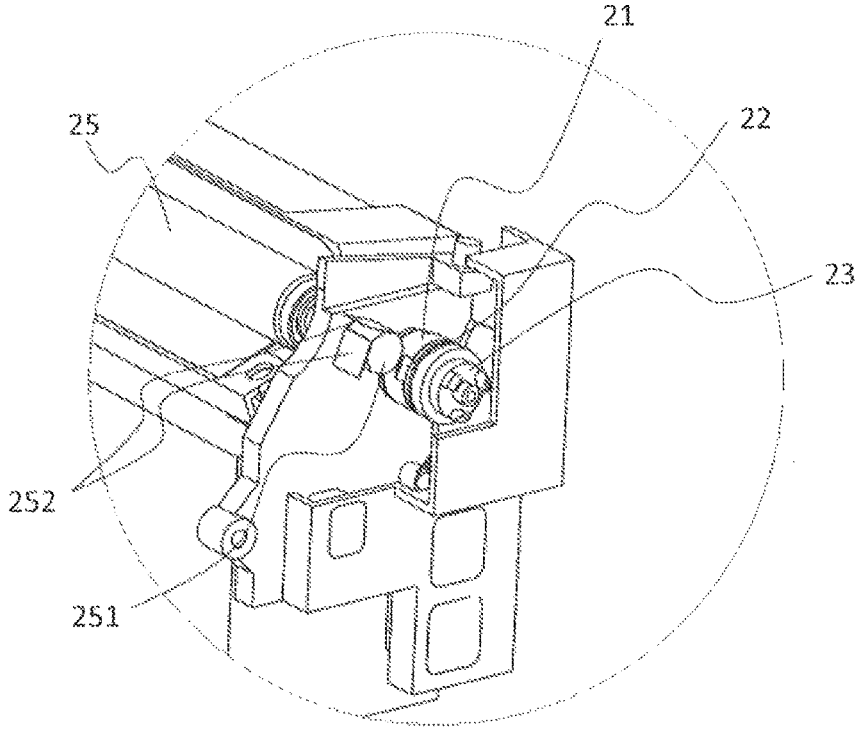
FIG. 24 is a perspective view for illustrating a shaft coupling member and a flexible sheet for removing chips in an embodiment of the present invention.
Figure 25:
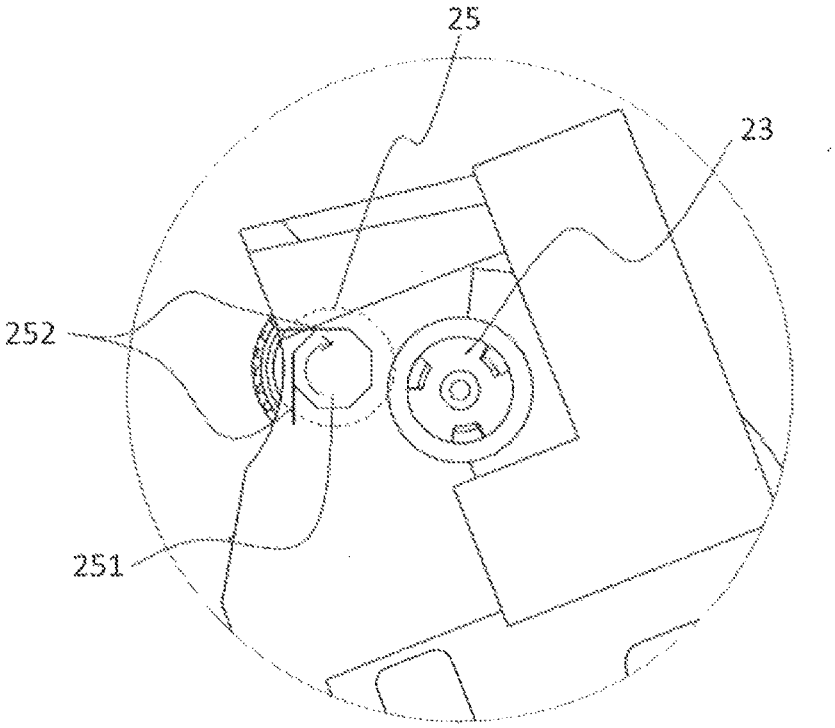
FIG. 25 is a side view of a shaft coupling member and a flexible sheet for removing chips in an embodiment of the present invention.

As shown in FIGS. 24 and 25, in order to remove the produced chips, a flexible sheet 252 is contacted to at least a part of the Oldham coupling 20 (the intermediary engaging portion 22, the driving-side engaging portion 23, and/or the follower-side engaging portion 21). The flexible sheet 252 is bonded using the a double-sided tape or the like on a rotatable supporting member 251 which is rotatably supported at one longitudinal end of the developing roller 25, and is intermittently contacted to the part of the Oldham coupling 20 by the rotation of the developing roller 25 to remove the produced chips.

(Positioned Relationship Between Bearing Contact Portion and Photosensitive Drum in Process Cartridge)

Figure 21:
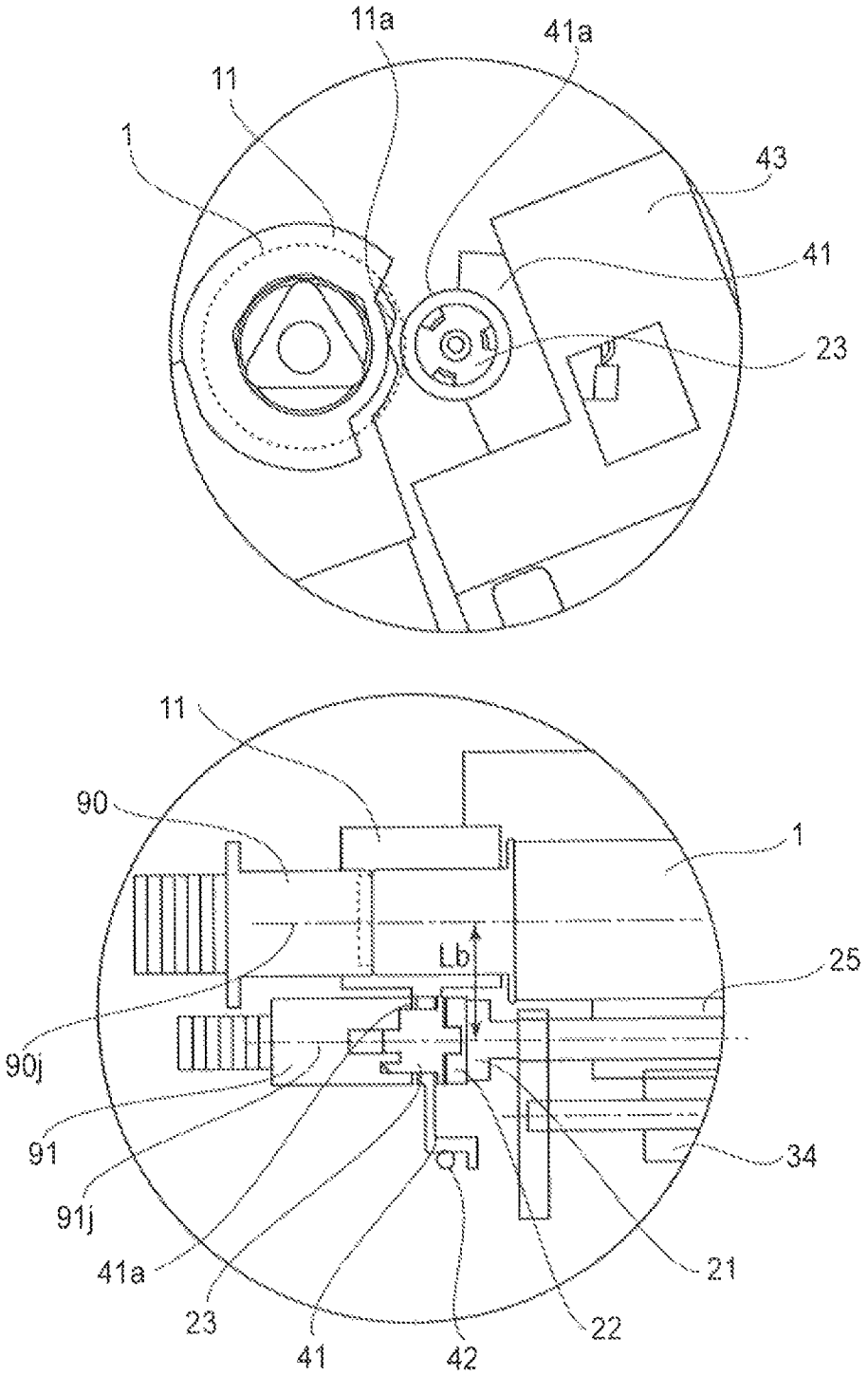
FIG. 21 includes a side view and a sectional view for illustrating an operation of shaft coupling members when a developing unit is in a contact state and a driving-side engaging portion and a main assembly developing coupling engage with each other a conventional example.

Next, a positional relationship between the bearing contact portion 11*a* and the photosensitive drum 1 in the process cartridge 70 according to shift embodiment will be described using FIGS. 19 and 21.

FIG. 19 includes a side view and a sectional view of a state in which the developing roller 25 and the photosensitive drum 1 are spaced from each other in this embodiment.

Here, the bearing contact portion 11*a* which is a feature portion in this embodiment will be described.

The bearing contact portion 11*a* is a contact portion provided on the rear drum bearing 11 against which the holding portion 41 abuts. When the driving-side engaging portion 23 engages with the main assembly developing coupling 91, the position of the driving-side engaging portion 23 is determined by the main assembly developing coupling portion. However, when the process cartridge 70 is inserted into the main assembly in the state in which the developing roller and the photosensitive drum are spaced from each other, the driving-side engaging portion 23 does not readily engage with the main assembly developing coupling depending on the position of the driving-side engaging portion. In this embodiment, the position of the main assembly developing coupling is determined by the main assembly, and therefore in order to facilitate engagement between the driving-side engaging portion and the main assembly developing cartridge during the insertion of the process cartridge into the main assembly, there is a need to determine the position of the driving-side engaging portion. For that reason, in this embodiment, a constitution in which in the case where the driving-side engaging portion and the main assembly developing coupling do not engage with each other, the holding portion 41 is urged against the bearing contact portion 11*a* by the spring 42 is employed. By that constitution, the holding portion 41 is positioned to the bearing contact portion 11*a*, with the result that even in the case where the driving-side engaging portion and the main assembly developing cartridge do not engage with each other, the position of the driving-side engaging portion is determined.

As shown in FIG. 19, a shape of the bearing contact portion 11*a* is required to be such a shape that the bearing contact portion 11*a* contacts the holding portion at least at two points. Therefore, in this embodiment, the bearing contact portion 11*a* has a V-character shape. In this embodiment, in FIG. 19, contact points (contact portions) are 411 and 412. Then, in this embodiment, all the contact points are disposed so as to be outside the outer peripheral surface of the photosensitive drum 1 on a plane perpendicular to the rotational axis 90*j* of the photosensitive drum. Further, the bearing contact portion 11*a* is required to be disposed in a driving member (developing roller) side than the outer peripheral surface of the develop 1 with respect to a direction of a rectilinear line L1 connecting a rotation center 1*a* of the photosensitive drum 1 and a rotation center 34*a* of the developer supplying roller 34 which is a driving member for receiving drive from the main assembly via the coupling. In this embodiment, a constitution in which with respect to the direction of the rectilinear line L1 connecting the rotation center 1*a* of the photosensitive drum 1 and the rotation center 34*a* of the developer supplying roller 34 which is the driving member for receiving drive from the main assembly via the coupling, the contact point closest to the photosensitive drum is disposed between the outer peripheral surface of the photosensitive drum 1 and the rotation center 34*a* was employed. By such a constitution, even when the process cartridge is downsized, a distance between an axis of the apparatus main assembly-side drive transmitting portion for transmitting the rotational difference to the photosensitive drum and an axis of the apparatus main assembly-side drive transmitting portion for transmitting the rotational difference to the second unit is capable of being made large. Further, in this embodiment, the contact points 411 and 412 of the bearing contact portion 11*a* against which the holding portion 41 abuts were provided outside the outer peripheral surface of the photosensitive drum 1 and inside the outer peripheral surface of the developing roller 25. In this embodiment, a constitution in which all the contact points are provided inside the outer peripheral surface of the developing roller 25 is employed, but when a constitution in which at least one contact point is provided inside the outer peripheral surface of the developing roller 25, it is possible to reduce an excessive degree of upsizing of the process cartridge. Further, at least all the contact points are required to be positioned between the center of the photosensitive drum and the center of the developer supplying roller.

Next, a distance between the axis 90*j* of the main assembly drum coupling 90 and the axis 91*j* of the main assembly developing coupling 91 is La. As a comparison example, a constitution in which the bearing contact portion 11*a* against which the holding portion 41 abuts is provided inside the outer peripheral surface of the photosensitive drum 1 is shown in FIG. 21. In this figure, the bearing contact portion 11*a* is inside the peripheral speed of the photosensitive drum 1, and therefore all the contact points between the bearing contact portion 11*a* and the holding portion are inside the outer peripheral surface of the photosensitive drum 1. At this time, a distance between the axis 90*j* of the main assembly drum coupling 90 and the axis 91*j* of the main assembly developing coupling 91 is Lb.

In this way, by providing the bearing contact portion, against which the holding portion 41 abuts, outside the outer peripheral surface of the photosensitive drum 1, it becomes possible to make the distance between the axis 90*j* of the main assembly drum coupling 90 and the axis 91*j* of the main assembly developing coupling 91 larger (La>Lb).

Therefore, it becomes possible to further ensure a clearance between the main assembly drum coupling 90 and the main assembly developing 91, so that a degree of flexibility in design and arrangement of the apparatus main assembly 100A can be improved. Further, also in the process cartridge 70, the photosensitive drum 1 and the developing roller 25 are made to have a small diameter, so that it also becomes possible to further downsize the process cartridge 70.

In FIG. 19, an example in which the bearing contact portion 11*a* against which the holding portion 41 abuts was provided outside the outer peripheral surface of the photosensitive drum 1 and inside the outer peripheral surface of the developing roller 25 was shown. Here, as shown in FIG. 22, even when the bearing contact portion 11*a* against which the holding portion 41 abuts is outside the outer peripheral surface of the photosensitive drum 1 and is outside the outer peripheral surface of the developer supplying roller 34, a similar effect can be obtained.

Figure 23:
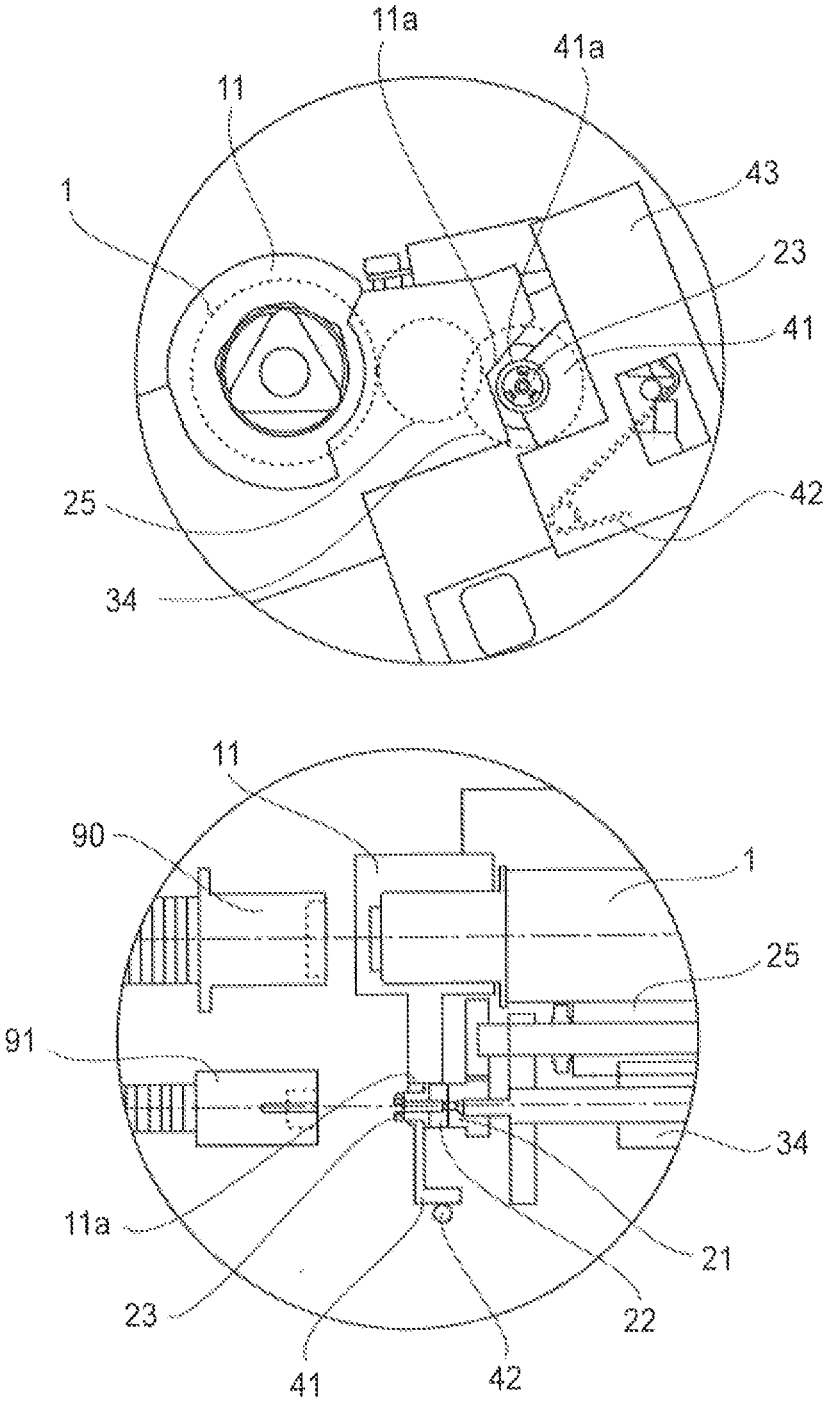
FIG. 23 includes a side view and a sectional view for illustrating a positional relationship of the drive inputting portion in the case where the abutting portion is provided outside the outer peripheral surface of a photosensitive drum and is provided inside the outer peripheral surface of the developer supplying roller in another embodiment of the present invention.

Further, as shown in FIG. 23, even when the bearing contact portion 11*a* against which the holding portion 41 abuts is outside the outer peripheral surface of the photosensitive drum 1, outside the outer peripheral surface of the developing roller 25, and is inside the outer peripheral surface of the developer supplying roller 34, a similar effect can be obtained.

Figure 22:
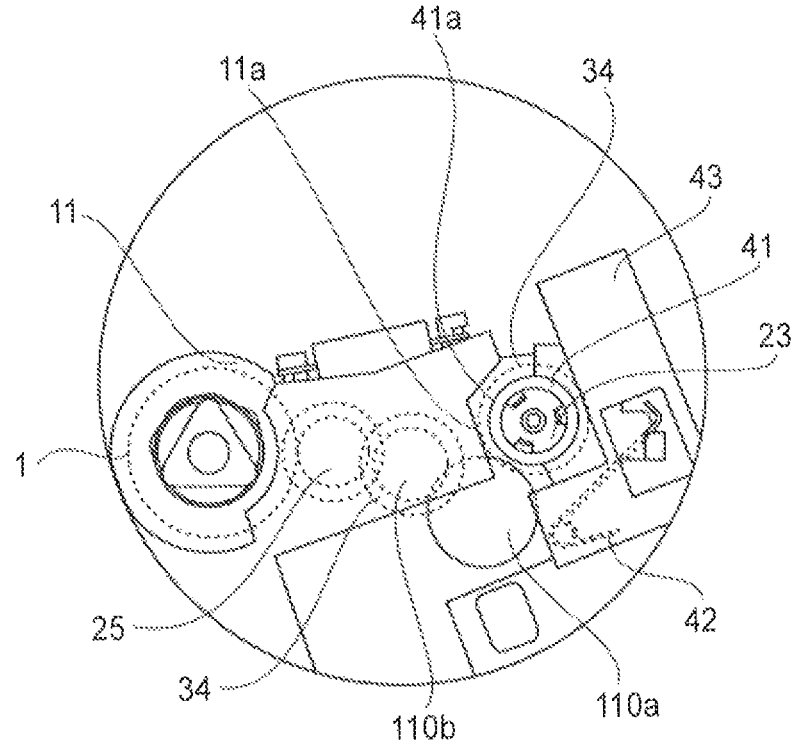
FIG. 22 includes a side view and a sectional view for illustrating a positional relationship of a drive inputting portion in the case where an abutting portion is provided outside an outer peripheral surface of a photosensitive drum and is provided outside an outer peripheral surface of the developer supplying roller in another embodiment of the present invention.
Figure 22:
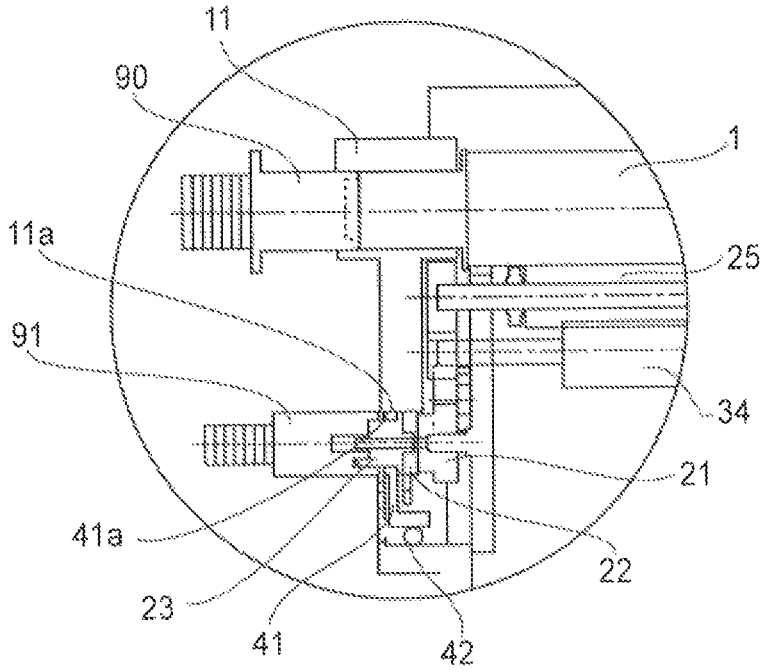

However, as shown in FIG. 22, in the case where the bearing contact portion 11*a* against which the holding portion 41 abuts is outside the outer peripheral surface of the photosensitive drum 1 and is in a position deviated from between the photosensitive drum center and the developer supplying roller center and is outside the outer peripheral surface of the developer supplying roller 34, there is a need to transmit the second rotational difference, inputted from the apparatus main assembly 100A, to the developer supplying roller 34 and the like via the gears 110*a*, 110*b* and the like, thus leading to an increase of the number of parts.

Further, as shown in FIG. 23, in the case where the bearing contact portion 11*a* against which the holding portion 41 abuts is outside the outer peripheral surface of the photosensitive drum 1, outside the outer peripheral surface of the developing roller 25, and is inside the outer peripheral surface of the developer supplying roller 34, when the Oldham coupling 20 is provided on the developer supplying roller shaft in order to prevent the increase of the number of parts, the driving-side engaging portion 23 becomes small and leads to a lowering in strength. Therefore, the bearing contact portion 11*a* against which the holding portion 41 abuts may desirably be outside the outer peripheral surface of the photosensitive drum 1 and is between the center of the photosensitive drum and the center of the developer supplying roller (rotatable member), and further is outside the outer peripheral surface of the developer supplying roller.

By this, it becomes possible to make the distance between the axis 90*j* of the main assembly drum coupling 90 and the axis 91*j* of the main assembly developing coupling 91 large while avoiding the increase of the number of parts due to an increase of the number of the driving gears and the lowering in strength of the drive engaging portion.

INDUSTRIAL APPLICABILITY

According to the present invention, there are provided a process cartridge and an image forming apparatus which are capable of broadening an interval between drive input to a photosensitive drum and drive input to a developing roller.

The invention claimed is:

1. A process cartridge comprising:

a photosensitive drum;

a rotatable developing roller for developing an electrostatic latent image formed on the photosensitive drum;

a rotatable roller having a rotation shaft in a position deviated from an axis of the developing roller, the rotatable roller being configured for transmitting a driving force to the developing roller;

an Oldham coupling member disposed at an end portion of the shaft of the rotatable roller, the Oldham coupling including a drive receiving portion for receiving a driving force to be transmitted to the developing roller, wherein the drive receiving portion is movable relative to the rotatable roller in a direction crossing the shaft of the rotatable roller;

an urging member for urging the drive receiving portion in the direction crossing the shaft of the rotatable roller;

a supporting portion for rotatably supporting the drive receiving portion so as to be movable together with the drive receiving portion relative to the rotatable roller in the direction crossing the shaft of the rotatable roller;

an abutting portion for receiving the supporting portion urged by the urging member; and an elastic sheet provided at an end of the developing roller, wherein the elastic sheet is configured to rotate along with the developing roller and intermittently contact at least part of the Oldham coupling member by rotation of the elastic sheet.

2. A process cartridge according to claim 1, wherein the abutting portion is positioned outside an outer periphery of the photosensitive drum on a plane perpendicular to the shaft of the rotatable roller.

* * * * *